US008408486B2

(12) United States Patent
Di Stefano

(10) Patent No.: US 8,408,486 B2
(45) Date of Patent: Apr. 2, 2013

(54) IDLER

(76) Inventor: Carmelo Joseph Licciardi Di Stefano, Broadmeadows (AU)

( * ) Notice: Subject to any disclaimer, the term of this patent is extended or adjusted under 35 U.S.C. 154(b) by 284 days.

(21) Appl. No.: 12/658,319

(22) Filed: Feb. 8, 2010

(65) Prior Publication Data

US 2010/0200179 A1 Aug. 12, 2010

(30) Foreign Application Priority Data

Feb. 9, 2009 (AU) ..... 2009900503
Jun. 29, 2009 (AU) ..... 2009903030

(51) Int. Cl.
*B65H 75/18* (2006.01)
*A47G 5/02* (2006.01)

(52) U.S. Cl. ..... 242/407; 242/599; 160/323.1; 160/325; 160/326

(58) Field of Classification Search ..... 160/323.1, 160/324, 325, 326, 24; 248/269, 267, 292.12, 248/292.13, 257, 265; 403/350, 351, 352; 411/535, 536, 546; 401/66; 242/599, 599.1, 242/407
See application file for complete search history.

(56) References Cited

U.S. PATENT DOCUMENTS

| | | | | |
|---|---|---|---|---|
| 1,057,603 | A * | 4/1913 | Whitney | 160/301 |
| 3,315,728 | A * | 4/1967 | Anderson et al. | 160/326 |
| 3,340,922 | A * | 9/1967 | Anderson | 160/326 |
| 4,399,857 | A * | 8/1983 | Honma | 160/323.1 |
| 5,813,449 | A * | 9/1998 | Patmore et al. | 160/370.22 |
| 6,131,643 | A * | 10/2000 | Cheng et al. | 160/370.22 |
| 7,051,782 | B2 * | 5/2006 | Nichols et al. | 160/310 |
| 7,740,047 | B2 * | 6/2010 | Koop et al. | 160/323.1 |
| 2004/0182522 | A1 * | 9/2004 | Strand et al. | 160/84.05 |
| 2005/0217805 | A1 * | 10/2005 | Strand et al. | 160/168.1 P |
| 2008/0121353 | A1 * | 5/2008 | Detmer et al. | 160/266 |
| 2008/0142171 | A1 * | 6/2008 | Koop et al. | 160/243 |

FOREIGN PATENT DOCUMENTS

| | | |
|---|---|---|
| EP | 1806472 | 7/2007 |
| EP | 1936106 | 6/2008 |
| GB | 2339820 | 6/2002 |

* cited by examiner

*Primary Examiner* — Blair M Johnson
*Assistant Examiner* — Jaime F Cardenas-Garcia
(74) *Attorney, Agent, or Firm* — Head, Johnson & Kachigian, P.C.

(57) ABSTRACT

A length adjustable fitting for blind systems, including a housing and a drive member fitted to said housing; a core component including a core member shaped for engaging a drive portion of said drive member, the core component including a support portion shaped for engaging a support member for supporting said fitting; wherein, the selective adjustment of the drive member relative to the housing moves the core member along an axis to a different position relative to the housing, wherein at each said position, the drive member engages the core member to resist movement of the core member along the axis from said position relative to said housing.

13 Claims, 25 Drawing Sheets

IDLER

FIELD

The present invention relates to a length adjustable support fitting for blind systems.

BACKGROUND

A drive component is a selectively rotatable operating device for a user to control the extension and retraction of a cover, such as a window blind. The drive component may include one or more other components, such as but not being limited to a chain or cord driven winder, electric motor, crank, winch, and manual draw mechanism with a spring booster. The drive component may be coupled to one end of a tube (e.g. having a sheet material wrapped around it for use as a cover or blind when extended). When the drive component rotates in one direction, the tube rotates to extend the sheet material. Conversely, when the drive component rotates in the opposite direction, the tube rotates to retract the sheet material.

To enable the tube to rotate more smoothly, a drive component and another fitting (referred to as an idler) may be coupled to different respective ends of the tube. The drive component and idler are each supported by different respective supporting structures (e.g. mounting brackets), which in turn are fixed to a structure such as a window sill or a wall of a building.

However, variations may occur during the installation of the supporting structures. For example, the supporting structures may be installed in positions that are slightly too far apart for engaging the drive component and idler fitted to the end of a tube. Conversely, the supporting structures may be installed in positions that are slightly too close together for engaging the drive component and idler fitted to the end of a tube. In these circumstances, the supporting structures will need to be removed and reinstalled in the correct position (which may affect the quality of the finishing on the installation surface), or a tube of a new length may need to be reordered if the deviation in distance between the supporting structure and the drive component/idler is significant. Both of these options are undesirable, and add to the complication and time needed to successfully complete an installation.

It is therefore desired to address one or more of the above issues or problems, or to at least provide a more useful alternative to existing fittings.

SUMMARY

One aspect of the present invention provides a length adjustable fitting for blind systems, including:

a housing and a drive member fitted to said housing;

a core member shaped for engaging a drive portion of said drive member, the core member including an support portion shaped for engaging a support member for supporting said fitting;

wherein the selective adjustment of the drive member relative to the housing moves the core member along an axis to a different position relative to the housing, wherein in at each said position, the drive member engages the core member to resist movement of the core member along the axis from said position relative to said housing.

In the representative embodiment described herein, the fitting can be configured in a manner for avoiding or minimising accidental retraction of the core component along the axis.

BRIEF DESCRIPTION OF THE DRAWINGS

Representative embodiments of the present invention are herein described, by way of example only, with reference to the accompanying drawings, wherein.

DETAILED DESCRIPTION OF THE REPRESENTATIVE EMBODIMENTS

Figure 1:
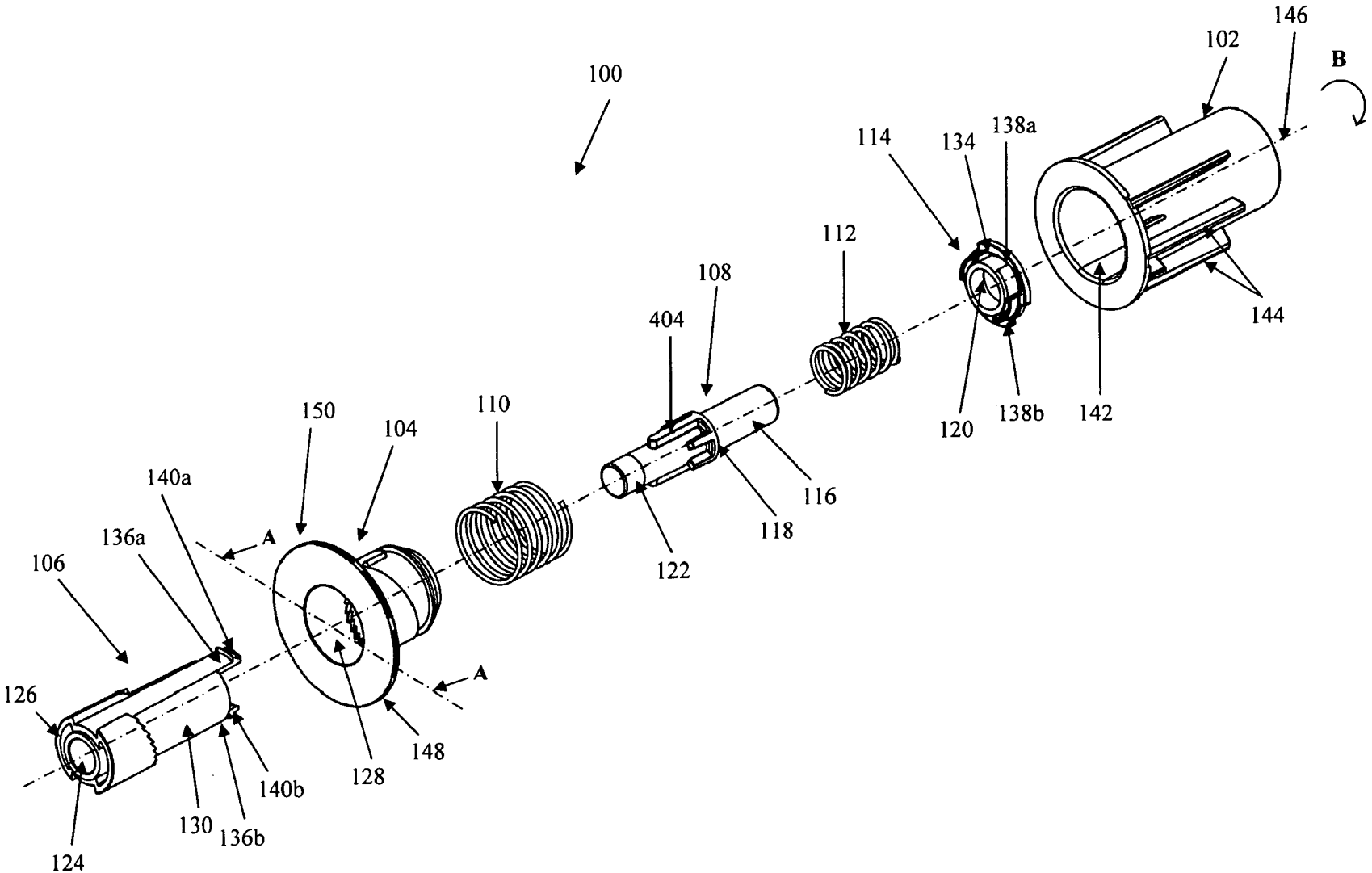
FIG. 1 is an exploded front perspective view of the components in a first representative embodiment of an idler.

The representative embodiments described in this specification relate to a support fitting, which can be referred to as an idler 100, as shown in FIG. 1. The support fitting can also be referred to as a pin or pivot end device or mechanism. The support fitting provides a pivot for the rotation of a blind, and can be optionally configured to provide drive to other support fittings (e.g. for additional linked blinds). However, it will be understood that the components and/or mechanisms that enable the idler 100 to be adjustable in length can be adapted for use in complementing any drive component in a system that can be used for extending and retracting a blind or cover (such as, but not being limited to, a winder).

A representative embodiment of the idler 100, as shown in FIG. 1, includes a housing 102, rotatable drive member 104, core member 106, support member 108 (which can also be referred to as a pin member), first biasing means 110, second biasing means 112, and a locking sleeve 114. In the embodiment shown in FIG. 1, the first and second biasing means 110 and 112 are coil springs of different coil diameter. The core member 106 and the support member 108 can be collectively referred to as the core component.

The core member 106, support member 108, first biasing means 110, second biasing means 112, and locking sleeve 114 are assembled to the drive member 104 to form a length adjustable assembly, which is then fitted into the housing 102. These components may be assembled in the following manner.

The second biasing means 112 is fitted over a neck portion 116 located at one end of the support member 108. One end of the second biasing means 112 pushes against a flanged portion 118 of the support member 108, and the other end of the second biasing means 112 pushes against an inner rim portion 120 of the locking sleeve 114. A connecting portion 122 of the support member 108 (located at the end opposite to the end with the neck portion 116) is received into a hollow 124 of the core member 106. In the representative embodiment shown in FIG. 1, the hollow 124 is formed completely through the body of the core member 106 so that the connecting portion 122 of the support member 108 can protrude through an extending end portion 126 of the core member 106 when the support member 108 is fully received into the hollow 124.

The drive member 104 has a hollow 128 shaped for receiving the core member 106. In the representative embodiment shown in FIG. 1, the hollow 128 is formed completely through the body of the drive member 104 so that a neck portion 130 of the core member 106 can protrude through a tail end 132 (see FIG. 3) of the drive member 104 when the core member 106 is fully received into the hollow 128. The first biasing means 110 is fitted over the neck portion 130 of the core member 106. One end of the first biasing means 110 pushes against the tail end 132 of the drive member 104, and the other end of the first biasing means 110 pushes against an outer rim portion 134 of the locking sleeve 114.

The core member 106 has one or more retaining arms 136*a* and 136*b* shaped for being securely received into one or more corresponding openings 138*a* and 138*b* formed in the locking sleeve 114. For example, each of the retaining arms 136*a* and 136*b* has an enlarged head portion 140*a* and 140*b* that are received into the openings 138*a* and 138*b*, so that the enlarged head portions 140*a* and 140*b* engage with at least a part of the openings 138*a* and 138*b* to resist detachment of the locking sleeve 114 from the core member 106 when the parts are connected. The coupling between the core member 106 and the locking sleeve 114 are not limited to an arrangement as described above. For example, the core member 106 and locking sleeve 114 may be coupled together by any fastening means, including but not being limited to one or more fastening devices (e.g. a pin or spring clip) and/or one or more fastening mechanisms (e.g. including a screw and thread coupling arrangement).

Figure 3:
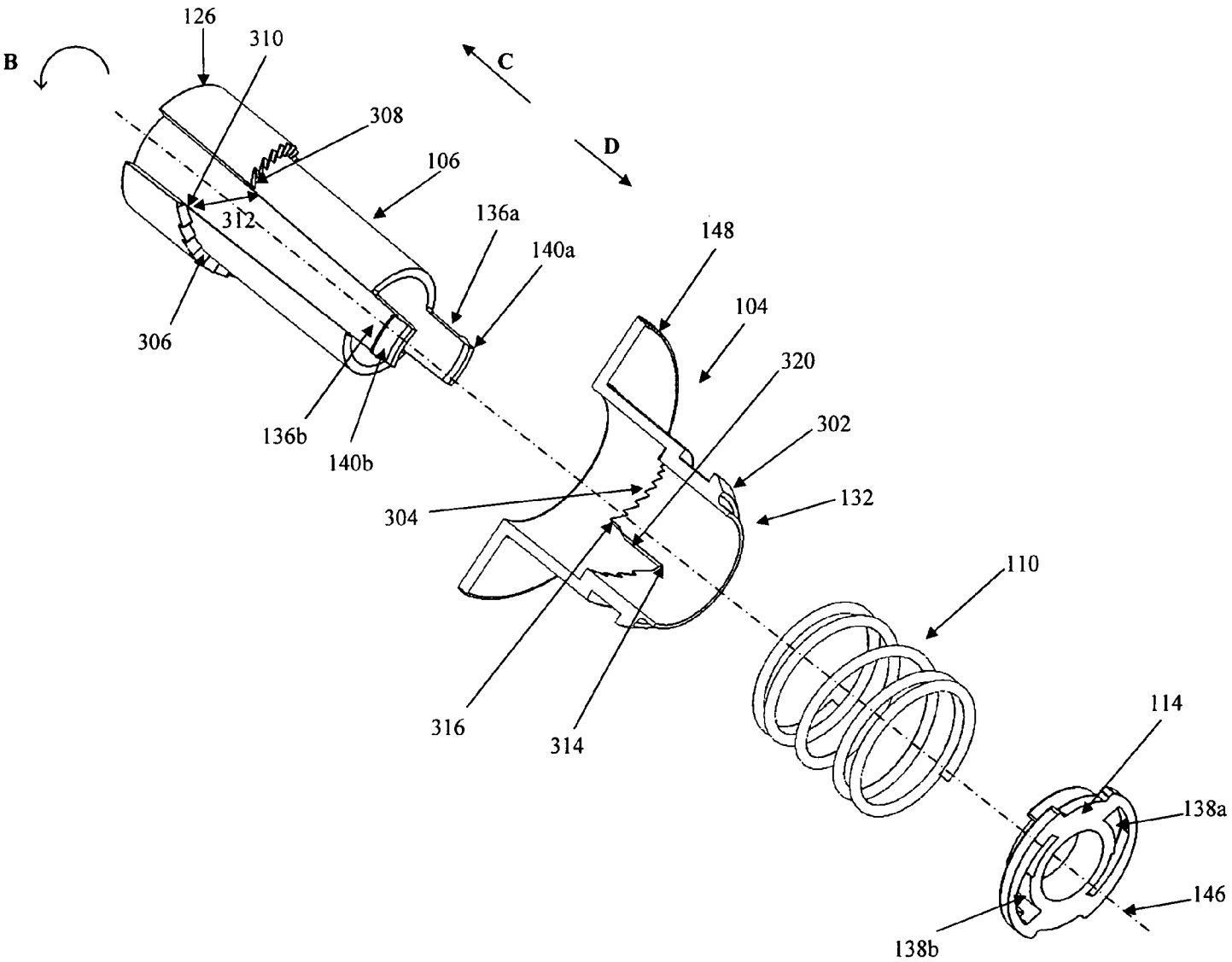
FIG. 3 is an exploded perspective view of the components for adjusting the position of a core member of the idler in FIG. 1.

In the representative embodiment shown in FIGS. 1 and 3, each of the openings 138*a* and 138*b* may include a large opening portion and a smaller opening portion. This configuration is particularly advantageous since the large opening portions can receive the enlarged head portions 140*a* and 140*b* with minimal resistance, and the locking sleeve 114 can then be rotated to a locking position so that the smaller opening portions can securely engage the enlarged head portions 140*a* and 140*b* for resisting detachment of the locking sleeve 114 from the core member 106. The design of the locking sleeve 114 shown in FIG. 1 can therefore help simplify the assembly of the idler 100.

Figure 5:
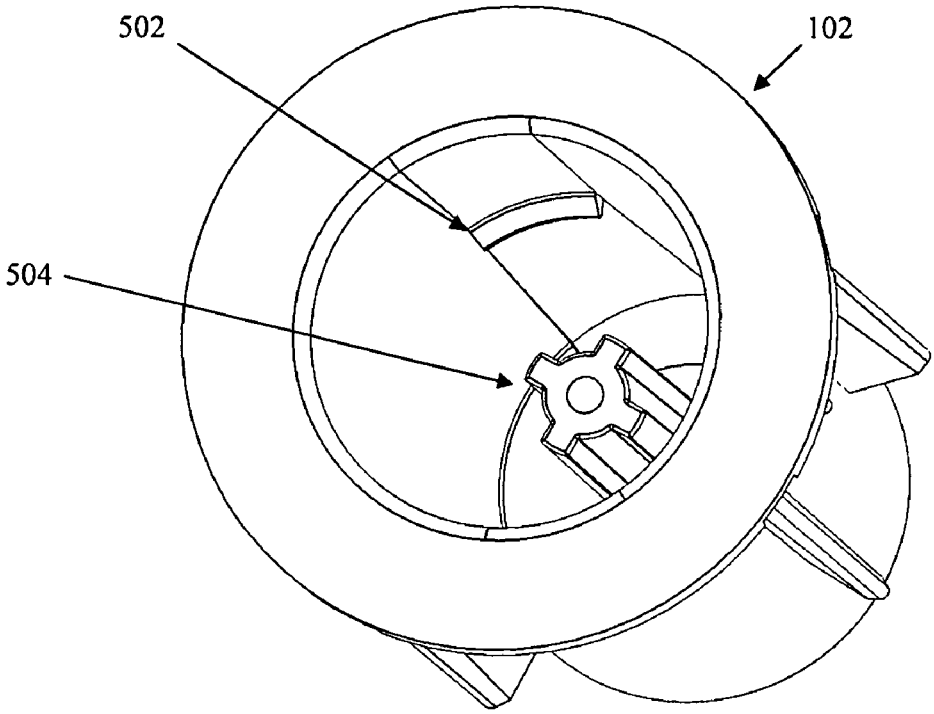
FIG. 5 is a perspective view of a housing of the idler in FIG. 1.
Figure 6:
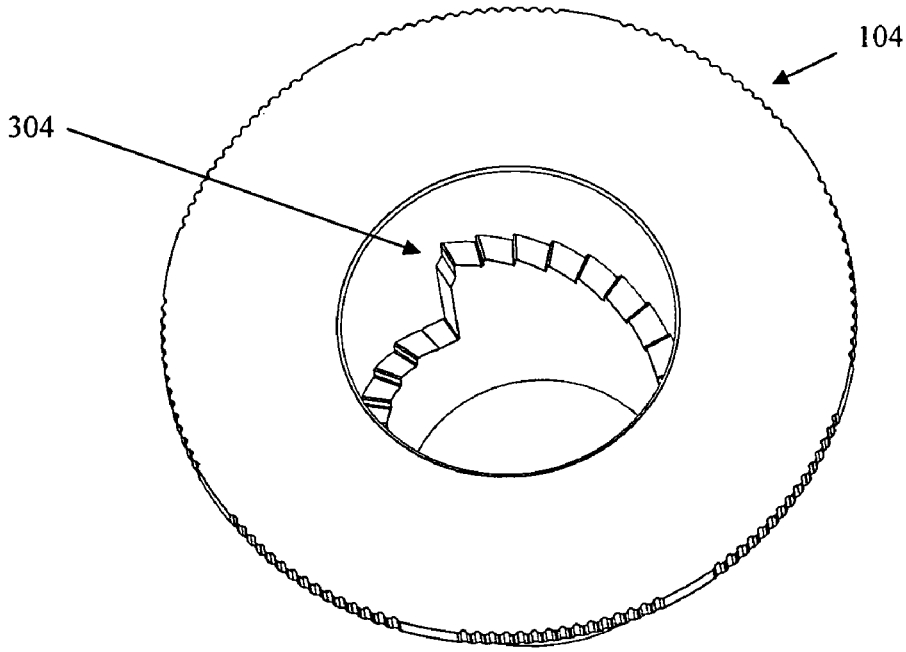
FIGS. 6 and 7 are perspective and side views of a drive member of the idler in FIG. 1.
Figure 7:
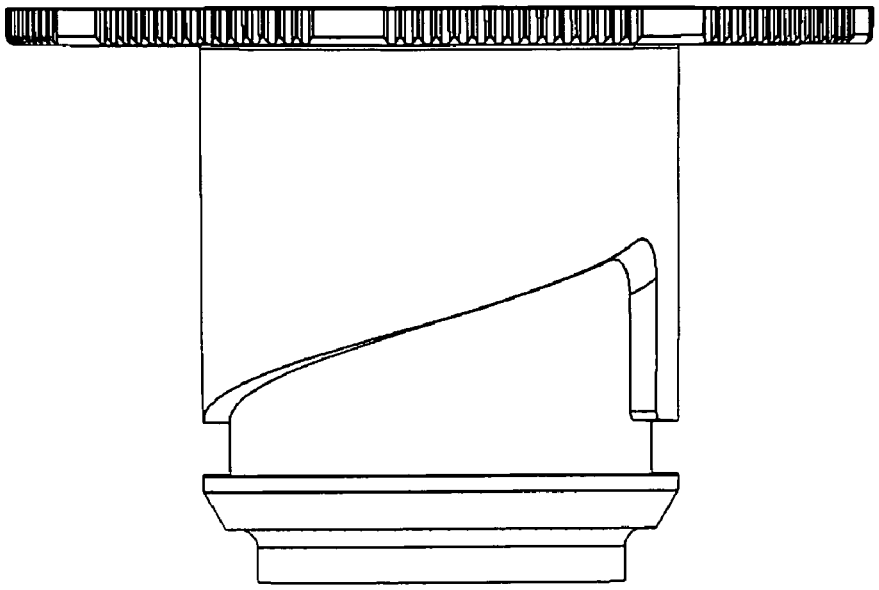
Figure 8:
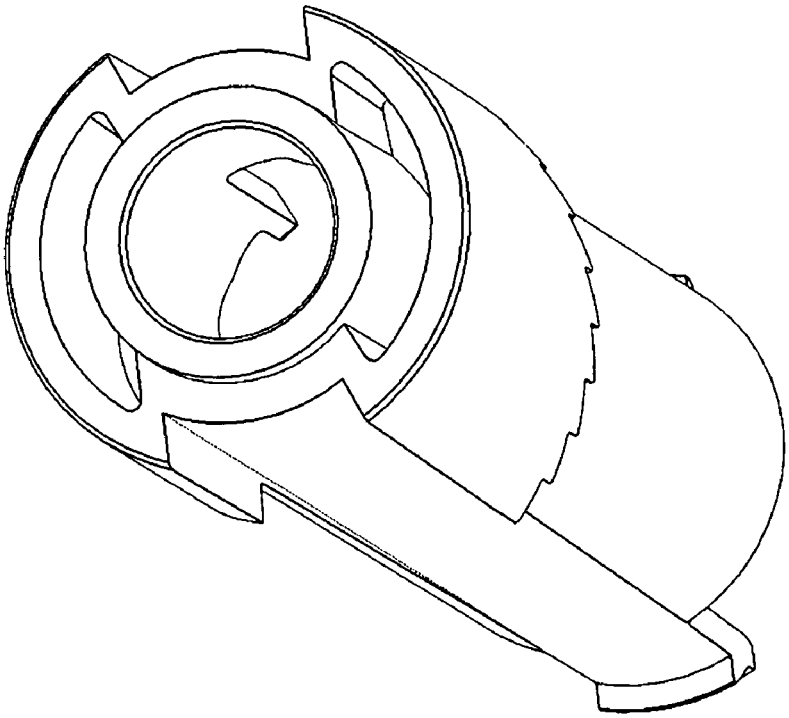
FIG. 8 is a perspective view of the core member of the idler in FIG. 1.

The drive member 104 (assembled with the other components forming the length adjustable assembly) is then fitted into a hollow portion 142 of the housing 102. As shown in FIG. 5, the housing 102 includes one or more retaining tabs 502 for engaging at least a part of an enlarged retaining head portion 302 (which may be formed to include a ring, see FIG. 3) located adjacent to the tail end 132 of the drive member 104. In this way, the engagement of the retaining head portion 302 with the one or more retaining tabs 502 resists detachment of the drive member 104 from the housing 102. The coupling between the drive member 104 and the housing 102 are not limited to the arrangement as described above. For example, in other representative embodiments, the drive member 104 and housing 102 may be coupled together by any fastening means, including but not being limited to one or more fastening devices (e.g. a pin or spring) and/or one or more fastening mechanisms (e.g. including a screw and thread coupling arrangement).

The housing 102 has one or more fins 144 for engaging an inner surface of a tube (not shown in FIG. 1) having a sheet material wrapped around it for use as a cover or blind when extended. In other representative embodiments, the coupling between the housing 102 and the tube can be provided by any coupling means, including but not being limited to a friction fit arrangement and any other mechanical coupling arrangement. The styling and arrangement of the coupling between the housing 102 and the tube may be determined by the profile of the tube. When the idler 100 rotates with the tube about an axis 146 in a first direction (e.g. a blind extending direction as represented by direction arrow B in FIG. 1), the tube rotates to extend the sheet material. Conversely, when the idler 100 rotates with the tube about the axis 146 in an opposite direction (i.e. a blind retracting direction opposite to direction arrow B in FIG. 1), the tube rotates to retract the sheet material.

Referring to FIG. 3, when the components of the idler 100 are assembled, the core member 106 engages a drive portion 304 of the drive member 104 such that, when the drive member 104 is selectively rotated relative to the housing 102 in a first direction (e.g. a length extending direction as represented by direction arrow B in FIG. 3), the core member 106 moves to a different retaining position along the axis 146 relative to the housing 102. The core member 106 is positioned at a different distance away from the housing 102 at each different retaining position. In FIG. 3, the drive member 104 is shown in a cross-section view (taken along section A-A of FIG. 1).

Figure 9:
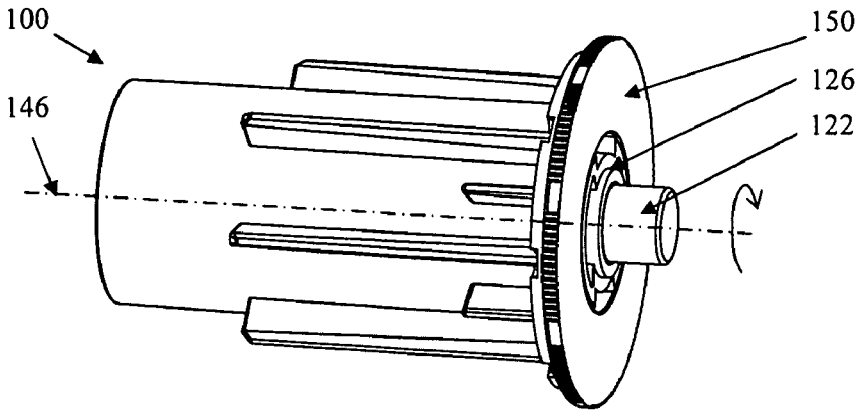
FIGS. 9 to 12 show the idler in FIG. 1 in different configurations in use.
Figure 10:
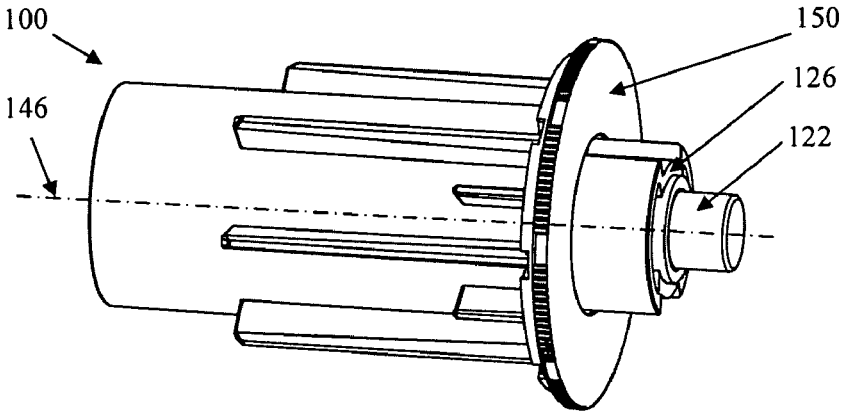
Figure 13:
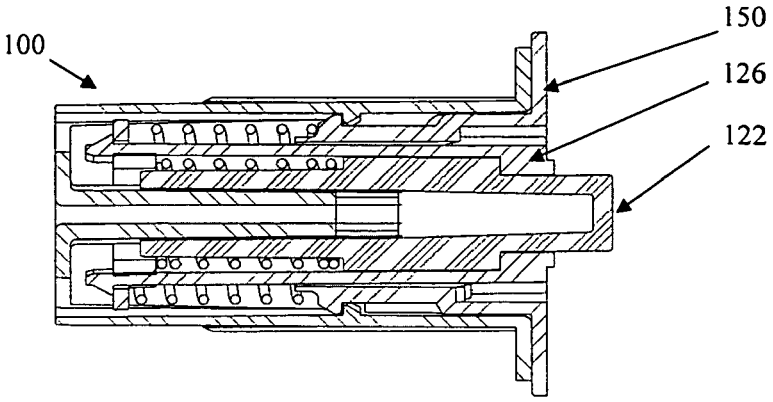
FIGS. 13 to 16 are cross-sectional views of the idler in FIG. 1 in different configurations corresponding to FIGS. 9 to 12 respectively.
Figure 14:
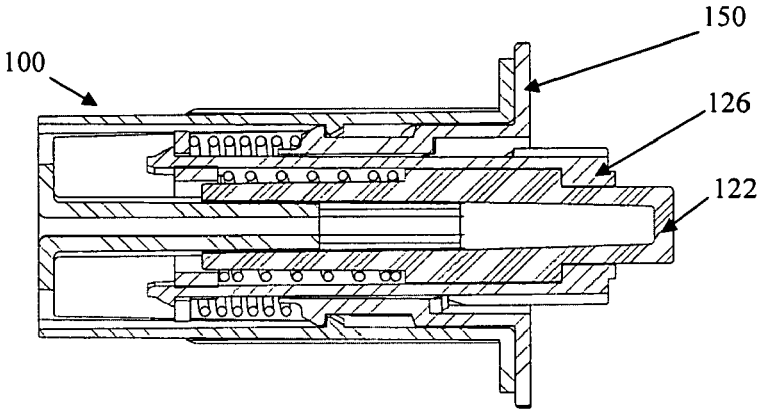

The core member 106 is selectively moveable along the axis 146 between a retracted position and an extended position. In the retracted position, the extending end portion 126 of the core member 106 is positioned adjacent to the drive member 104 (which is securely attached to the housing 102). For example, when the core member 106 is placed in the retracted position (see FIGS. 9 and 13), the core member 106 is wholly received within the housing 102 and at least a part of the extending end portion 126 of the core member 106 sits flush with an outer flange surface 150 of the drive member 104.

Conversely, in the extended position, the extending end portion 126 of the core member 106 projects outside of the housing 102 and is positioned away from the drive member 104. For example, the extending end portion 126 of the core member 106 (in the extended position) may extend up to a set distance (e.g. about 1 to 2 centimeters) away from the outer flange surface 150 of the drive member 104.

The core member 106 includes a first serrated surface 306 shaped for engaging a correspondingly shaped second serrated surface (which is part of the drive portion 304).

In the embodiment shown in FIG. 3, the first serrated surface 306 includes a combination of angled surfaces (e.g. angled relative to the axis 146) and locking surfaces or retaining portions (e.g. aligned in parallel to the axis 146) arranged in a helical shaped path in a "stair case" (or zig-zag) configuration around an outer surface of the core member 106. The first serrated surface 306 extends from a low start position 308 to a high end position 310, and the start and end positions 308 and 310 are separated by a gap 312 (to allow the core member 106 to return to a retracted position).

Similarly, the second serrated surface of the drive portion 304 includes a combination of angled surfaces (e.g. angled relative to the axis 146) and locking surfaces or retaining portions (e.g. aligned in parallel to the axis 146) arranged in a complementary helical shaped path in a "stair case" (or zig-zag) configuration around an inner surface of the drive member 104 surrounding the hollow 128. The second serrated surface 304 extends from a low start position 314 to a high end position 316, and the start and end positions 314 and 316 are separated by a gap 320 (to allow the core member 106 to return to a retracted position).

When the core member 106 is placed in the retracted position, the low start position 308 of the first serrated surface 306 is positioned at the low start position 314 of the second serrated surface of the drive portion 304. However, when the core member 106 is placed in the extended position, the low start position 308 of the first serrated surface 306 is positioned at the high end position 316 of the second serrated surface of the drive portion 304 (to position the core member 106 further away from the housing 102).

The first biasing means 110 biases the locking sleeve 114 to move away from the tail end of the 132. In the representative embodiment shown in FIG. 3, the first biasing means 110 (e.g. a coil spring) pushes against the tail end 132 of the drive member 104 and an outer rim portion 134 of the locking sleeve 114. Since the core member 106 is coupled to the locking sleeve 114 (by the retaining arms 136*a* and 136*b*), the core member 106 is biased to move towards the drive member 104. This causes the first and second serrated surfaces 306 and 304 to form an interlocking engagement with each other.

Figure 2:
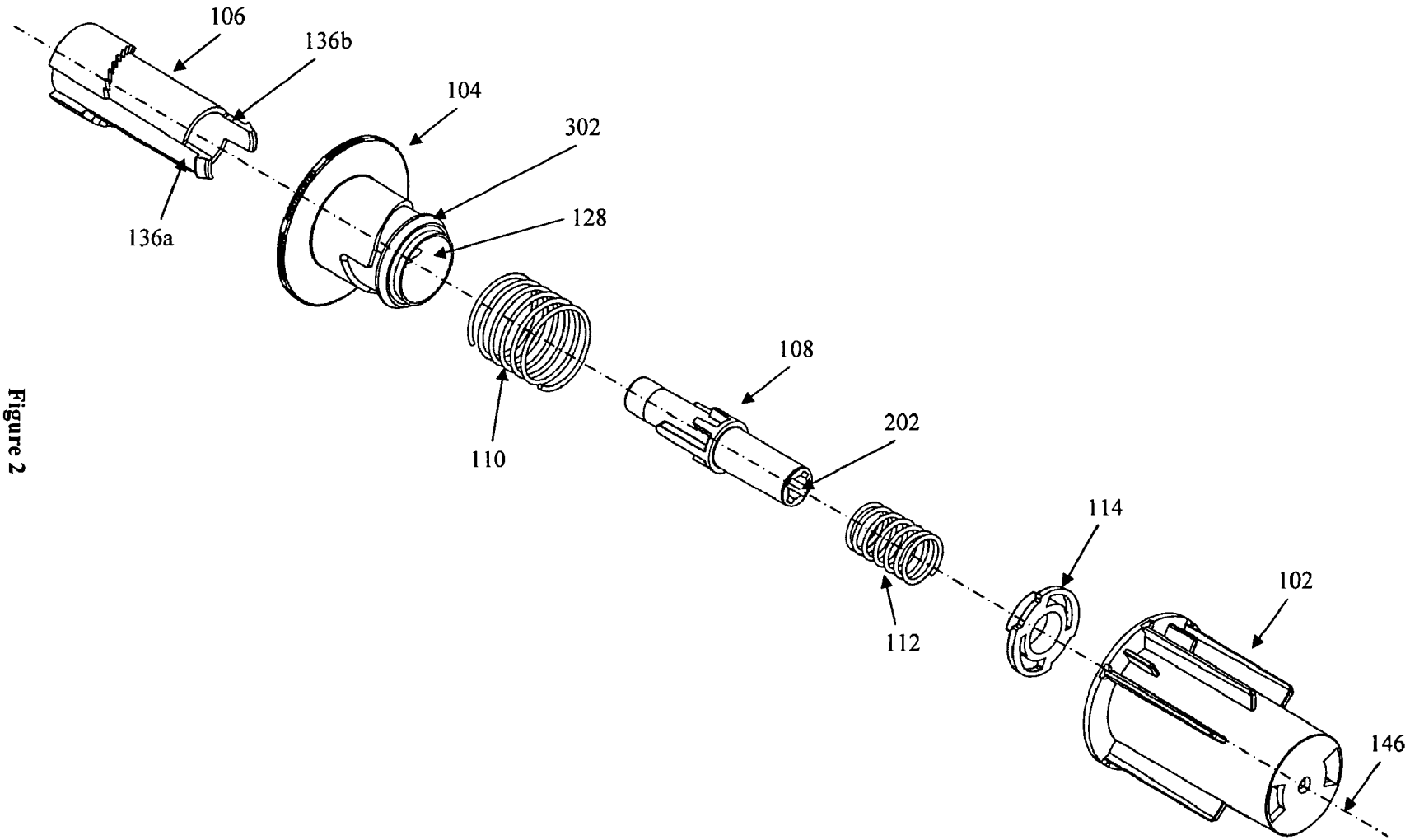
FIG. 2 is an exploded rear perspective view of the idler shown in FIG. 1.

The core member 106 is held in a locked position by the support member 108, and the support member 108 has an opening 202 (see FIG. 2) for receiving a stub 504 (see FIG. 5) formed inside the hollow portion 142 of the housing 102. The opening 202 has a cross-sectional shape corresponding to the cross-sectional shape of the stub 504, so that when the stub 504 is received into the opening 202, the engagement between the stub 504 and the opening 202 resists rotation of the support member 108 relative to the housing 102. This engagement also resists the core member 106 from rotating relative to the housing 102 when the core member 106 is held in the locked position by the support member 108.

When the drive member 104 is selectively rotated in the first direction (e.g. the length extending direction as represented by direction arrow B in FIG. 3) relative to the housing 102, the respective angled surfaces of the first and second serrated surfaces 306 and 304 allow the first and second serrated surfaces 306 and 304 to move past (or slide) past each other in opposite directions to different locking positions relative to each other. At each different locking position, the core member 106 is placed at a different retaining position relative to the drive member 104 and housing 102.

Due to the helical arrangement of the first and second serrated surfaces 306 and 304 (and since the core member 106 is held in the locked position by the support member 108), movement of first and second serrated surfaces 306 and 304 relative to each other (when the drive member 104 rotates in the first direction) causes the core member 106 to move towards the extended position (e.g. shown by direction arrow C in FIG. 3).

When the drive member 104 stops rotating, the first biasing means 110 biases the core member 106 to move towards the retracted position (i.e. towards the drive member 104, as represented by direction arrow D in FIG. 3). As a result, the angled surfaces of the first and second serrated surfaces 306 and 304 allow the drive member 104 to rotate (slightly) in the opposite direction (i.e. the length retracting direction opposite to direction arrow B in FIG. 3) and the core member 106 to move (slightly) towards the retracted position until the respective locking surfaces on the first and second serrated surfaces 306 and 304 engage each other to resist further rotation of the drive member 104. As a result, the locking engagement formed between the locking surfaces resists further movement of the core member 106 along the axis 146 towards the retracted position.

Accordingly, when the core member 106 is configured to the retracted position:

i) rotation of the drive member 104 in the first (length extending) direction moves the core member 106 towards the extended position; and ii) rotation of the drive member 104 in the opposite (length retracting) direction causes both the drive member 104 and the core member 106 to engage so as to resist movement of the core member 106 towards the retracted position.

When the core member 106 is configured to the extended position:

i) rotation of the drive member 104 in the first (length extending) direction moves the core member 106 towards the retracted position (since further rotation of the drive member 104 causes the low start position 308 of the first serrated surface 306 to disengage with the high end position 316 of the second serrated surface 304, and the gaps 312 and 320 allow the low start position 308 of the first serrated surface 306 to re-engages with the low start position 314 of the second serrated surface 304); and ii) rotation of the drive member 104 in the opposite (length retracting) direction causes the drive member 104 and the core member 106 to engage so as to resist movement of the core member towards the retracted position.

The extendibility of the core member 106 is particularly useful as it make it easier for a user to properly install or mount a covering assembly to supporting structures. For example, a covering assembly refers to the combination of a tube (with a covering or blind material wrapped around it) coupled to fittings (including a length adjustable fitting as described herein) for securing the ends of the tube to respective supporting structures (e.g. mounting brackets). If the supporting structures are placed too far away from the ends of the covering assembly, the length adjustable fitting enables the user to quickly and easily adjust the effective length of the fitting so that the supporting structure (in its existing position) can still engage with the covering assembly. This eliminates the need for repositioning the existing supporting structure(s) or modifying the covering assembly to use a tube of different length. The support member 108 can be retracted into the core member 106 for dismounting the covering assembly from the supporting structure(s) and the support member 108 can then be selectively extended from the core member 106 at a later stage for reinstallation or reuse.

Figure 4:
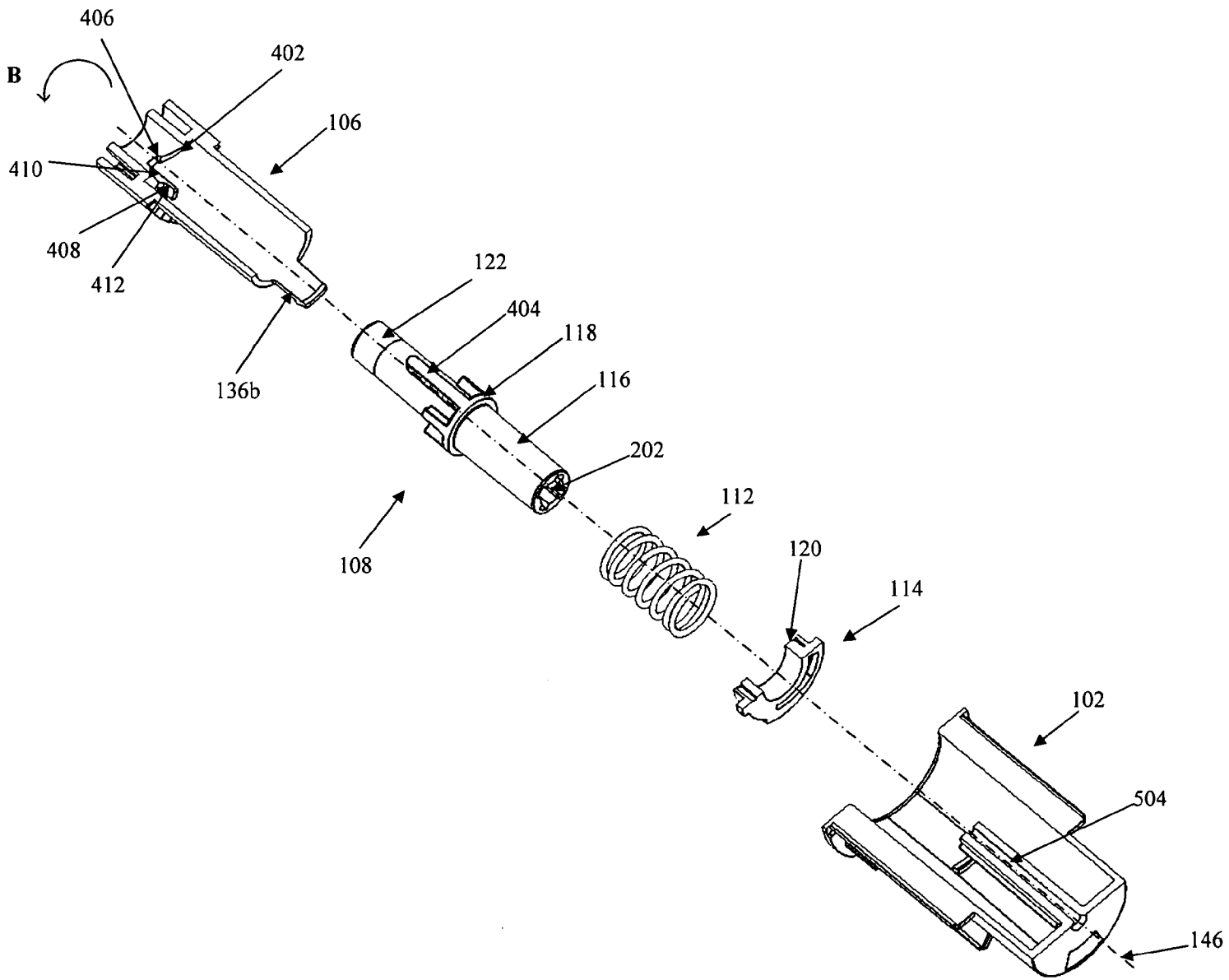
FIG. 4 is an exploded perspective view of the components for adjusting the position of a support member of the idler in FIG. 1.

Referring to FIG. 4, when the idler 100 is assembled, the support member 108 engages a cam portion 402 of the core member 106 such that, when the drive member 104 is selectively rotated in the opposite direction (e.g. opposite to direction arrow B in FIG. 4), the support member 108 moves to a different position along the axis 146 relative to the core member 106. In FIG. 4, the core member 106, locking sleeve 114 and housing 102 are shown in a cross-section view (taken along section A-A of FIG. 1).

Figure 11:
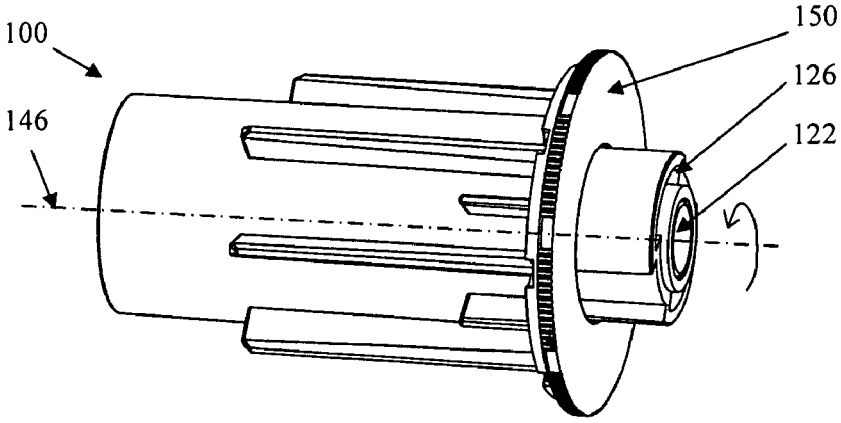
Figure 12:
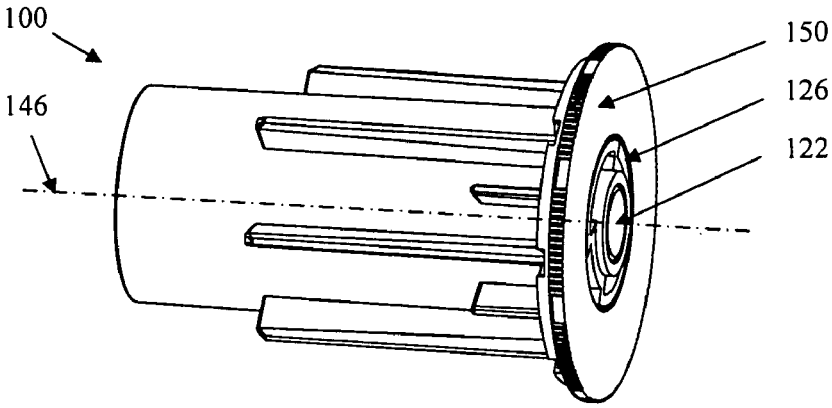
Figure 15:
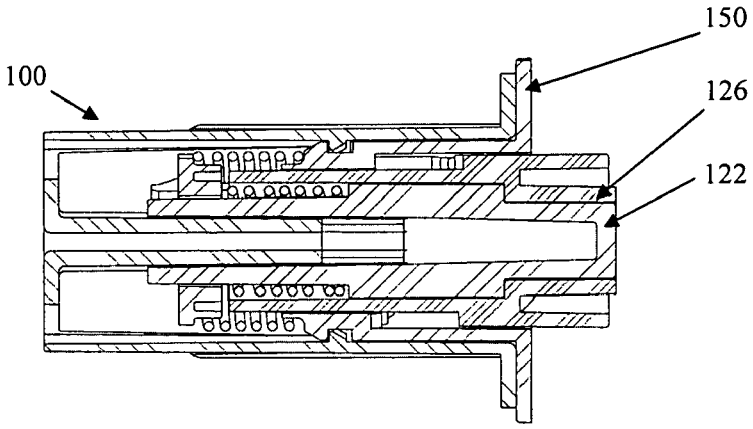
Figure 16:
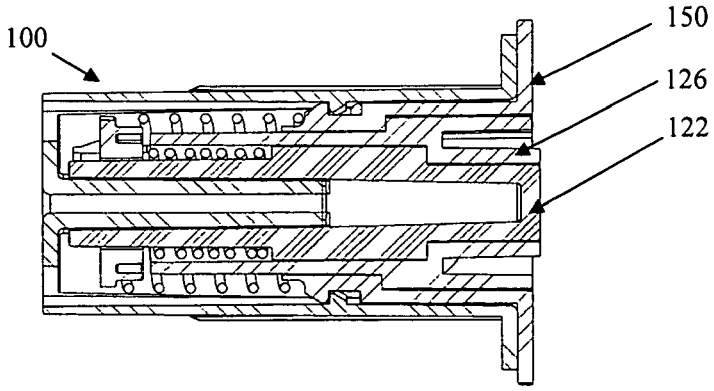

The support member 108 is selectively moveable along the axis 146 between a retracted position and an extended position. In the retracted position, the connecting portion 122 of the support member 108 is wholly received within the core member 106 and is positioned adjacent to the extending end portion 126 of the core member 106. For example, the connecting portion 122 of the support member 108 sits flush with at least a part of the extending end portion 126 of the core member 106 when the support member 108 is placed in the retracted position (see FIGS. 11 and 15).

Conversely, in the extended position, the connecting portion 122 of the support member 108 projects outside of the core member 106 and is positioned away from the extending end portion 126 of the core member 106. For example, the connecting portion 122 of the support member 108 (in the extended position) may extend up to a set distance (e.g. about 1 to 2 centimeters) from the extending end portion 126.

The support member 108 includes a guide member 404 shaped for engaging a cam surface (which is part of the cam portion 402 of the core member 106).

In the representative embodiment shown in FIG. 4, the cam portion 402 includes a continuous cam surface arranged in a helical configuration around an inner surface of the core member 106. The cam surface extends from a high start position 406 to a low end position 408. The core member 106 includes a first wall portion 410 located adjacent to the high start position 406 of the cam surface, for resisting movement of the guide member 404 past the high start position 406. The core member 106 also includes a second wall portion 412 located adjacent to the low end position 408 of the cam surface, for resisting movement of the guide member 404 past the low end position 408.

When the support member 108 is placed in the extended position, the guide member 404 is positioned at the high start position 406 of the cam portion 402. The second biasing means 112 has one end pushing against the inner rim portion 120 of the locking sleeve 114 and another end pushing against the flanged portion 118 of the support member 108. The second biasing means 112 therefore biases the support member 108 towards the extended position.

When the drive member 104 is rotated in the first (length extending) direction (e.g. represented by direction arrow B in FIG. 4), which in turn attempts to rotate the core member 106 in the same direction (e.g. due to the interlocking engagement formed between the first and second serrated surfaces 306 and 304). However, the guide member 404 pushes against the first wall portion 410 of the core member 106 when the core member 106 attempts to rotate in the first direction. Since the guide member 404 is positioned in a fixed position relative to the support member 108 (and since the support member 108 is coupled to the stub 504 so that it resists rotation relative to the housing 102), the engagement formed between the guide member 404 and the first wall portion 410 also resists rotation of the core member 106 relative to the housing 102. However, the core member 106 can move along the axis 146 towards the extended position.

When the drive member 104 is rotated in the opposite (length retracting) direction (e.g. opposite to direction arrow B in FIG. 4), the engagement formed between the first and second serrated surfaces 306 and 304 resist rotation of the core member 106 relative to the drive member 104 in the opposite direction. Therefore, the core member 106 rotates together with the drive member 104 in the opposite direction, which causes the guide member 404 to follow the cam portion 402 from the high start position 406 to the low end position 408, thus moving the support member 108 towards the housing and towards the retracted position.

Accordingly, when the support member 108 is configured to the extended position:

i) rotation of the drive member 104 in the first (length extending) direction causes the support member 108 and the core member 106 to engage so as to resist further extension of the support member 108; and ii) rotation of the drive member 104 in the opposite (length retracting) direction moves the support member 108 towards the retracted position.

When the support member 108 is configured to the retracted position:

i) rotation of the drive member 104 in the first (length extending) direction moves the support member 108 towards the extended position assisted by force generated by the second biasing means 112; and ii) rotation of the drive member 104 in the opposite (length retracting) direction causes the support member 108 and the core member 106 to engage so as to resist further retraction of the support member 108.

The retractability of the support member 108 is particularly useful because retracting the support member 108 provides a quick and easy way for disengaging the covering assembly (as described above) from a supporting structure (e.g. for the covering assembly to be taken down for repair). The support member 108 can later be adjusted to the extended position to re-engage with the supporting structure so that the covering assembly is placed in its original installed position.

When the support member 108 is placed in the extended position (or partly along the axis 146 towards the retracted position), the support member 108 can move along the axis 146 towards the retracted position when a force is applied to the connecting portion 122 to move the support member 108 towards the retracted position. When the force is no longer applied to the support member 108, the support member 108 is biased (by the second biasing means 112) to move along the axis 146 towards the extended position.

Automatic retraction and extension of the support member 108 is particularly useful as it makes it easier for a user to install a covering assembly (as described above). When the clearance between the fitting (e.g. the idler 100) and the supporting structure is less than the length of the support member 108 extending from the fitting, the length of the support member 108 can be shortened by pushing the support member 108 along the axis 146 towards the retracted position. Once the fitting is positioned for engaging the supporting structure, the support member 108 is biased to automatically move towards the extended position to engage with the supporting structure.

Although the connecting portion 122 of the support member 108 has been described and shown as a solid protruding member, the connecting portion 122 may alternatively include a recess that is shaped for receiving a correspondingly shaped protrusion extending from a supporting structure for supporting the fitting (e.g. the idler 100). As a further alternative, the connecting portion 122 of a first idler 100 may be shaped (e.g. with a suitably shaped protrusion or recess) for coupling directly or indirectly (e.g. via an intermediate adapter component) to a correspondingly shaped connecting portion of another support fitting (e.g. a second idler or link drive unit) connected to another tube supporting another blind. In this way, the first idler 100 and the other support fitting can rotate together, which enables the respective tubes connected to the first idler 100 and the other support fitting to rotate in unison for extending or retracting a blind/screen as a single linked system.

Figure 17:
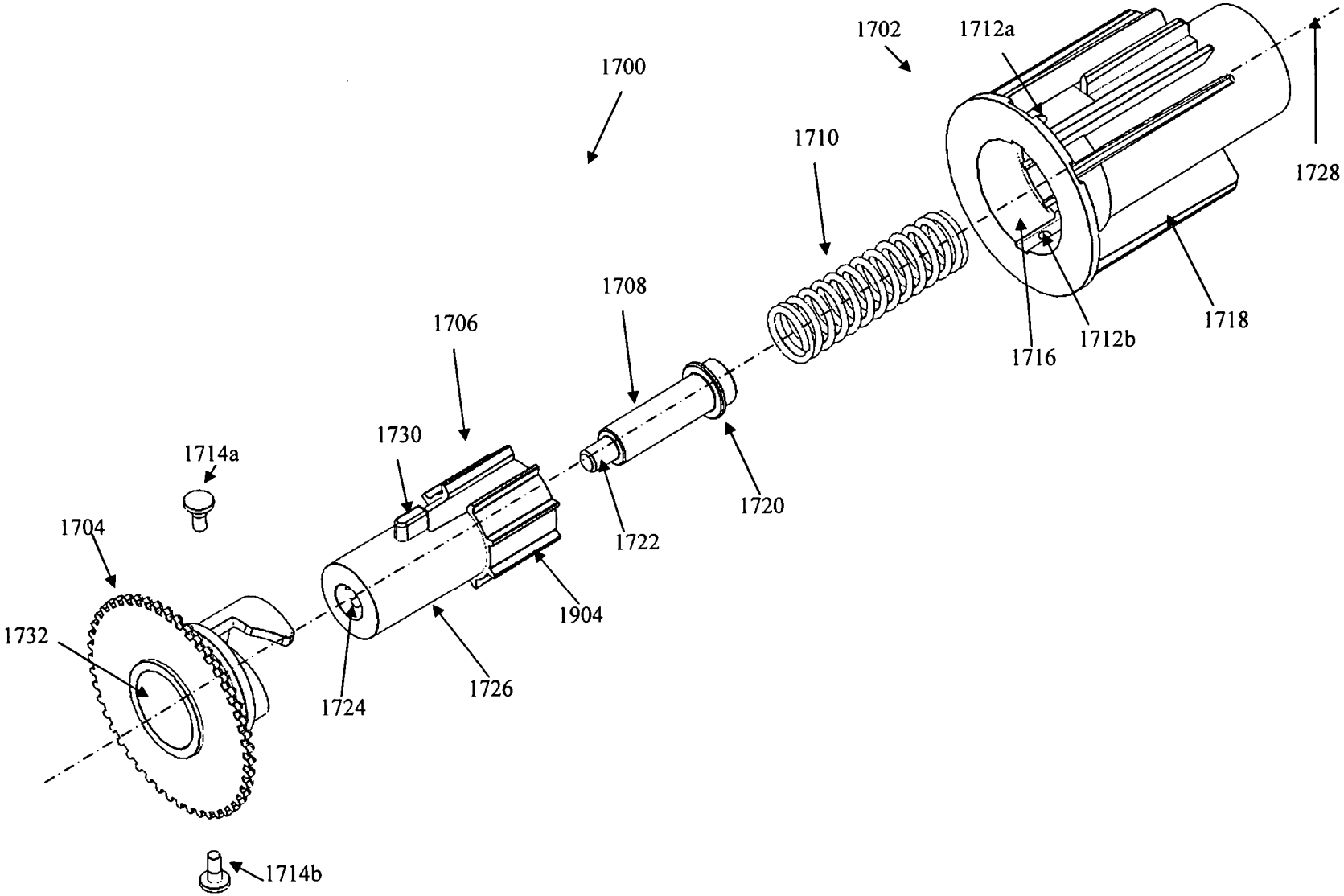
FIG. 17 is an exploded front perspective view of the components of a second representative embodiment of an idler.

FIGS. 17 to 35 relate to a second representative embodiment of the idler 1700, which has less mechanical parts and is of simpler construction than the idler 100 shown in FIGS. 1 to 16. As shown in FIG. 17, the idler 1700 has a housing 1702, drive member 1704, core member 1706, support member 1708 and primary biasing means 1710. The core member 1706 and the support member 1708 may be collectively referred to as the core component.

The housing 1702 may include one or more lock openings 1712*a* and 1712*b* that are each shaped for receiving a corresponding lock member 1714*a* and 1714*b*. When a lock member 1714*a* and 1714*b* is received into a lock opening 1712*a* and 1712*b*, a secure frictional engagement is formed between the lock member 1714*a* and 1714*b* and the lock opening 1712*a* and 1712*b* to resist disengagement from each other. Each lock member 1714*a* and 1714*b* has a body portion that protrudes through the lock opening 1712*a* and 1712*b* and into a hollow core 1716 of the housing 1702 to engage with a groove 1802 (see FIG. 18) formed in the drive member 1704. In this way, the lock members 1714*a* and 1714*b* helps to securely hold the drive member 1704 to the housing 1702 when the idler 1700 is assembled. The coupling between the drive member 1704 and the housing 1702 are not limited to the arrangement as described above. For example, in other representative embodiments, the drive member 1704 and housing 1702 may be coupled together by any fastening means, including but not being limited to one or more fastening devices (e.g. an integral clip or spring clip) and/or one or more fastening mechanisms (e.g. including a screw and thread coupling arrangement).

The housing 1702 also has one or more fins 1718 which provide a similar function to the fins 144 for the idler 100 shown in FIG. 1. Similar to the embodiment described with reference to FIG. 1, the coupling between the housing 1702 and the tube can be provided by any coupling means, including but not being limited to a friction fit arrangement and any other mechanical coupling arrangement. The styling and arrangement of the coupling between the housing 1702 and the tube may be determined by the profile of the tube.

The primary biasing means 1710 is fitted over a stub 1900 that projects into the hollow core 1716 of the housing 1702. One end of the primary biasing means 1710 pushes against a rear wall 1902 of the housing 1702 (see FIG. 19), while the other end of the primary biasing means 1710 pushes against a flanged portion 1720 of the support member 1708. The primary biasing means 1710 therefore biases the support member 1708 to move in a direction away from the rear wall 1902 of the housing 1702.

Figure 19:
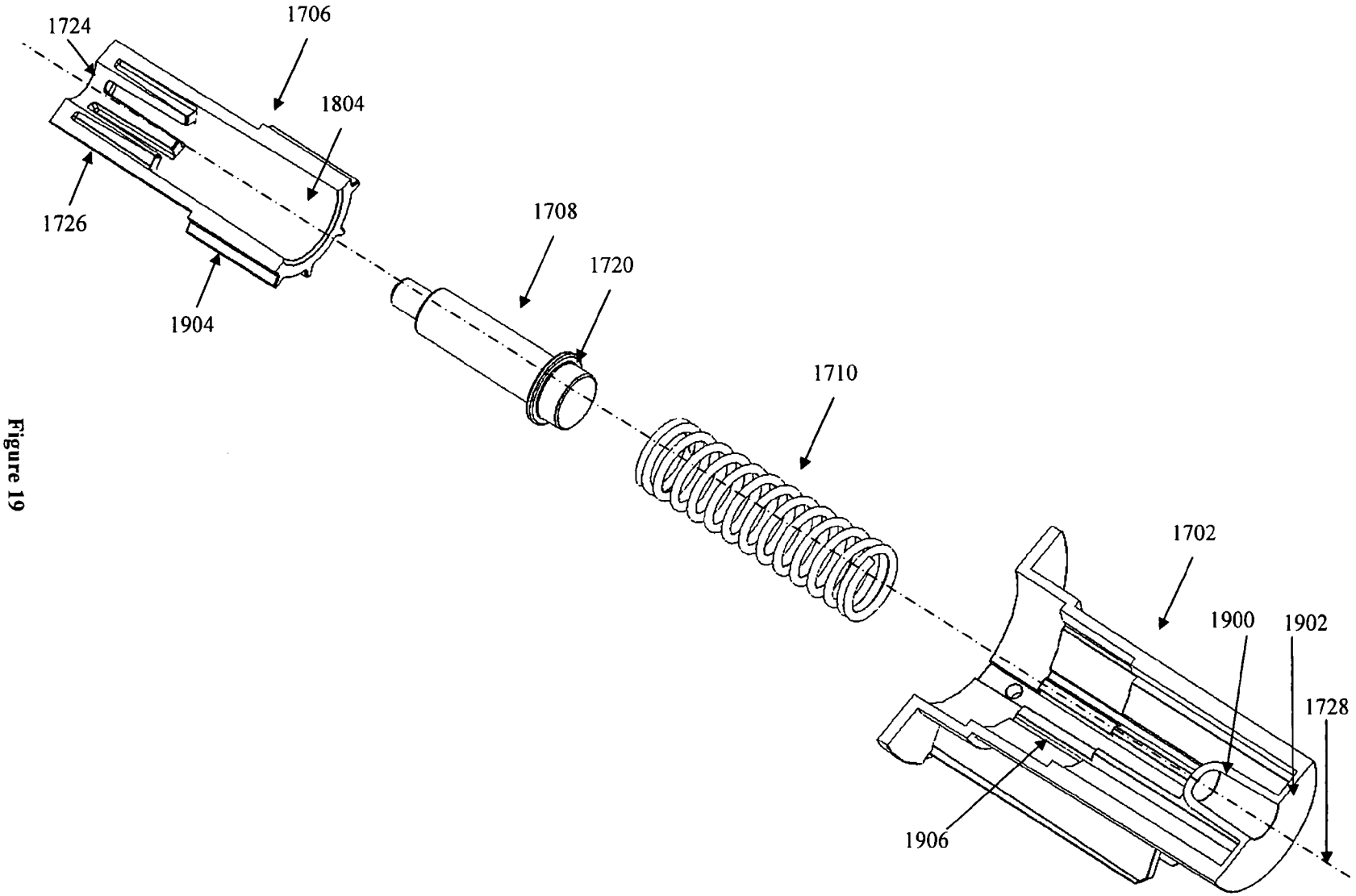
FIG. 19 is an exploded perspective view of the components for adjusting the position of a core member of the idler in FIG. 17.
Figure 20:
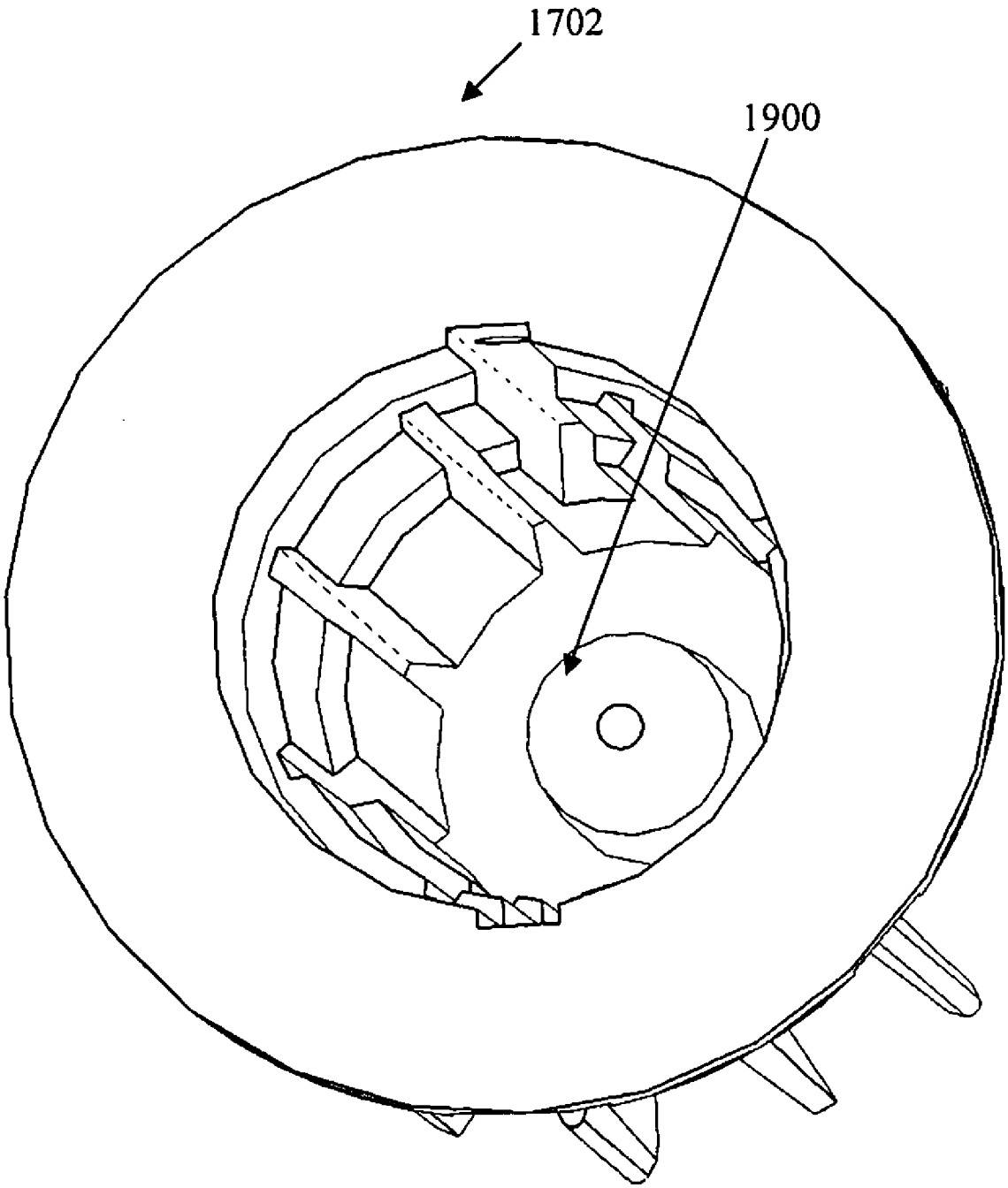
FIG. 20 is a perspective view of a housing of the idler in FIG. 17.

The core member 1706 has a tubular body with a bore 1804 shaped for receiving at least a part of the support member 1708, such that a connecting portion 1722 of the support member 1708 can project through an opening 1724 formed at the extending end portion 1726 of the core member 1706 (see FIGS. 17 and 19).

As shown in FIG. 19, the core member 1706 has one or more guiding fins 1904 that received into one or more corresponding guiding grooves 1906 formed in the housing 1702 (when the idler 1700 is assembled) for resisting rotation of the core member 1706 relative to the housing 1702 about a longitudinal axis 1728 of the housing 1702. However, when the guiding fins 1904 are received into the guiding grooves 1906, the core member 1706 can move along the axis 1728 relative to the housing 1702 (e.g. under force exerted by the primary biasing means 1710 and the mechanical interaction between the core member 1706 and the drive member 1704). The core member 1706 also has a guide member 1730 (e.g. a tab) projecting from an outside surface of the core member 1706.

Figure 18:
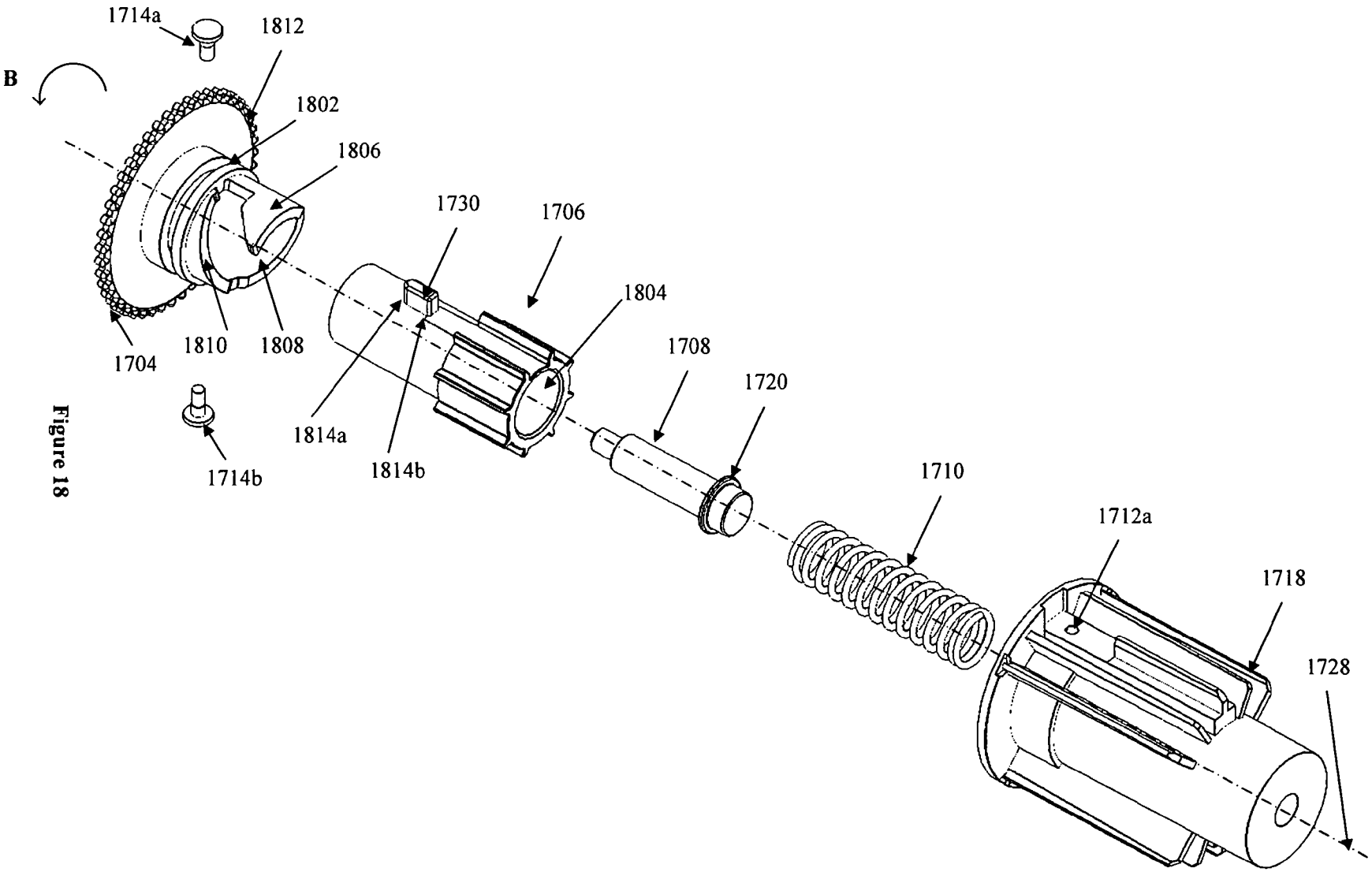
FIG. 18 is an exploded rear perspective view of the idler in FIG. 17.

As shown in FIG. 18, the drive member 1704 has an actuating portion 1812 for a user to grip the drive member 1704 for rotating it relative to the housing 1702. Similarly, the idler 100 shown in FIG. 1 also has a drive member 104 with an actuating portion 148. The drive member 1704 also has a wall portion 1806 that surrounds a bore 1808 shaped for receiving at least a part of the core member 1706, such that the extending end portion 1726 of the core member 1706 can project through an end opening 1732 (see FIG. 17) formed at an exterior facing end of the drive member 1704.

The wall portion 1806 of the drive member 1704 defines a helically shaped path 1810 for engaging the guide member 1730 of the core member 1706. In the representative embodiment shown in FIG. 18, the helically shaped path 1810 is defined by the edge of an opening formed through at a part of the wall portion 1806.

The representative embodiment of the idler 1700 shown in FIGS. 17 and 18 operates on similar principles to the representative embodiment of the idler 100 shown in FIG. 1. When the components of the idler 1700 are assembled, the core member 1706 engages the drive member 1704 (e.g. the helically shaped path 1810) such that, when the drive member 1704 is selectively rotated relative to the housing 1702 in a first direction (e.g. a length extending direction as represented by direction arrow B in FIG. 18), the core member 1706 moves to a different retaining position along the axis 1728 relative to the housing 1702.

Figure 26:
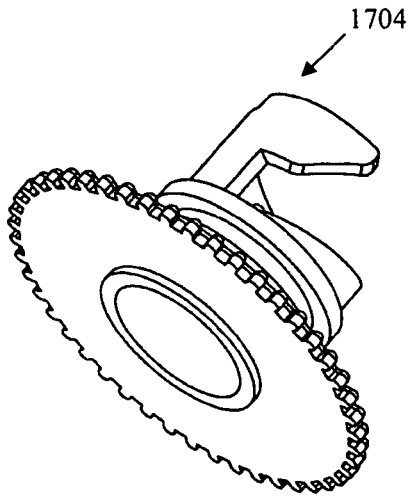
Figure 27:
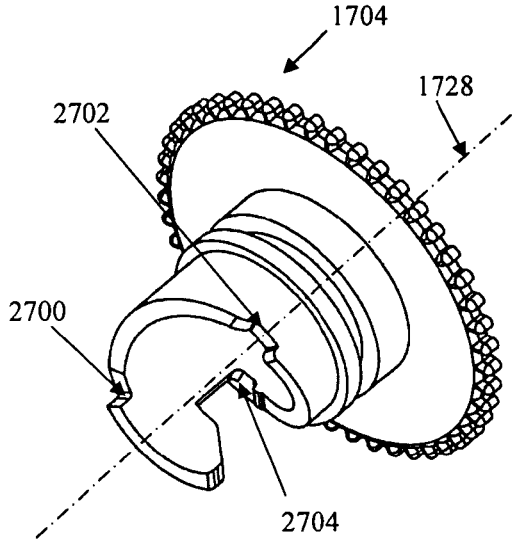
FIGS. 27 to 28 are perspective view of the drive member of the idler in FIG. 21.
Figure 28:
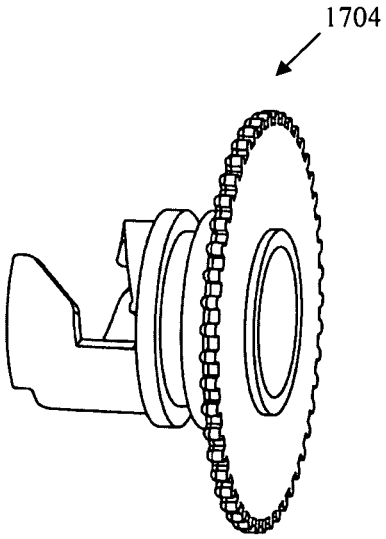
Figure 29:
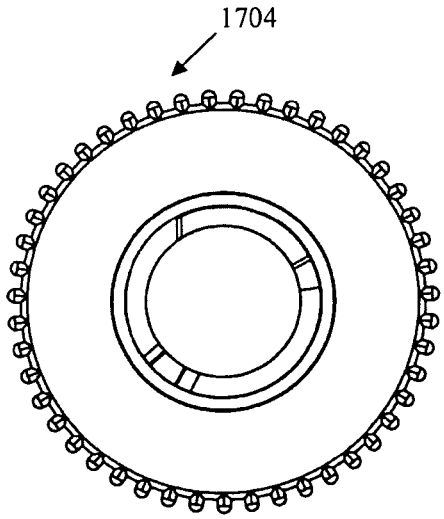
FIG. 29 is a rear view of the drive member of the idler in FIG. 21.

The helically shaped path 1810 has one or more retaining portion formed along the path, which are best seen in the representations shown in FIGS. 26 to 28. Referring to FIG. 27, the helically shaped path 1810 extends from a low position 2700, to a middle position 2702 and to a high position 2704. At each of the low, middle and high positions 2700, 2702 and 2704, the path 1810 is formed so as to provide a notch along a section of the path, such as by having a section of the path that is aligned substantially normal to the longitudinal axis 1728. When the guide member 1730 engages a notch at the low, middle or high position 2700, 2702 and 2704 (each corresponding to a relative locking position between the drive member 1704 and core member 1706), the guide member 1730 is able to be retained within the notch to resist further travel along the path 1810 under the force exerted by the primary biasing means 1710.

Figure 21:
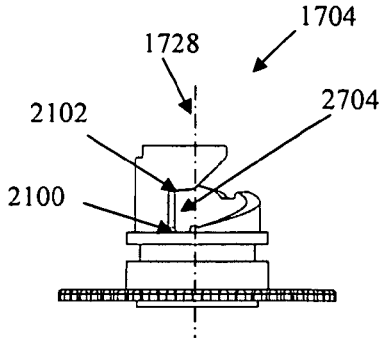
FIGS. 21 to 25 are top, left side, front, right side and bottom view of a drive member for use in the idler in FIG. 17.
Figure 22:
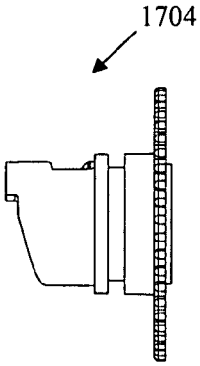
Figure 23:
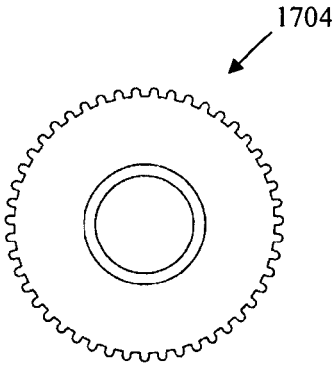
Figure 24:
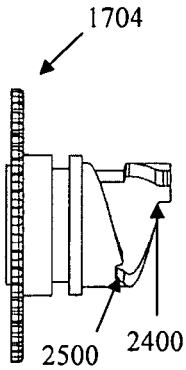
Figure 25:
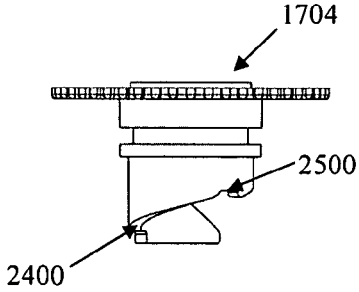

Referring to FIG. 21, the retaining portion at the high position 2704 of the path includes a first portion 2100 for engaging a front section 1814*a* of the guide member 1730, and a second portion 2102 for engaging a rear section 1814*b* of the guide member 1730. For example, both the first and second portions 2100 and 2102 include a section of the path that is aligned substantially normal to the axis 1728. When the guide member 1730 is received into the retaining portion at the high position 2704, the first and second portions 2100 and 2102 may engage the guide member 1730 so as to resist movement of the guide member 1730 along the axis 1728 (e.g. in the absence of rotation of the drive member 1704). When the drive member 1704 is rotated in the length retracting direction, the guide member 1730 disengages from the retaining portion at the high position 2704 and is able to proceed along the path 1810 towards the retaining portion at the middle position 2702.

The retaining portion at the middle position 2702 has a first portion 2500 for engaging the front section 1814*a* of the guide member 1730 to resist movement of the core member 1706 away from the rear wall 1902 of the housing 1702. The retaining portion at the middle position 2702 may not include a second portion for engaging the rear section 1814*b* of the guide member 1730. When the guide member 1730 is received into the retaining portion at the middle position 2702, the support member 1708 can be pushed (e.g. by a user) into the core member 1706 towards the rear wall 1902. When the drive member 1704 is rotated in the length extending direction, the guide member 1730 disengages from the retaining portion at the middle position 2702 and is able to proceed along the path 1810 towards the retaining portion at the high position 2704.

The retaining portion at the low position 2700 has a first portion 2400 for engaging the front section 1814*a* of the guide member 1730 to resist movement of the core member 1706 away form the rear wall 1902 o the housing 1702. The retaining portion at the low position 2700 may not include a section portion for engaging the rear section 1814*b* of the guide member 1730. When the guide member 1730 is received into the retaining portion at the low position 2700, the core member 1706 cannot move further into the housing 1702. When the drive member 1704 is rotated in the length extending direction, the guide member 1730 disengages from the retaining portion at the low position 2700 and is able to proceed along the path 1810 towards the retaining portion at the middle position 2702.

The support member 1708 is selectively moveable along the axis 1728 between a retracted position and an extended position. The core member 1706 will be at a maximum extended position when the guide member 1730 engages the notch at the high position 2704. Likewise, the core member 1706 will be at the maximum retracted position when the guide member 1730 engages the notch at the low position 2700.

Figure 30:
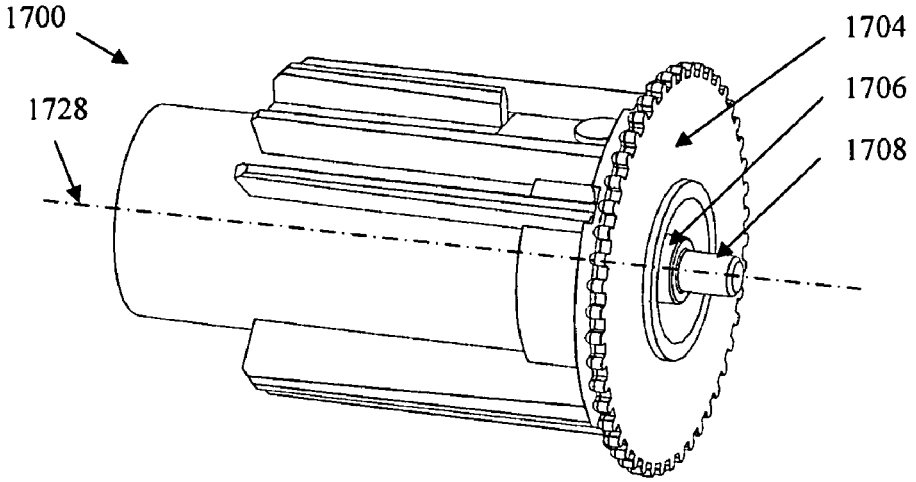
FIGS. 30 to 32 show the idler in FIG. 17 in different configurations of use.
Figure 31:
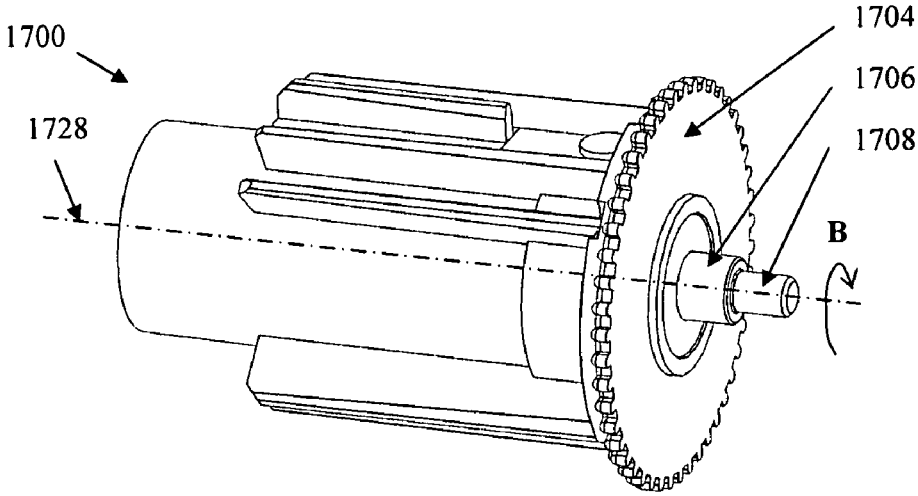
Figure 33:
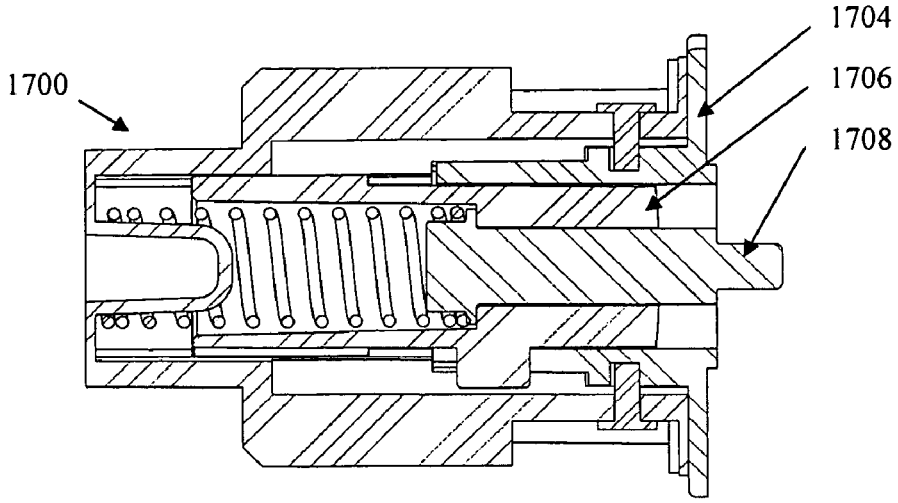
FIGS. 33 to 35 are cross-sectional views of the idler in FIG. 1 in different configurations corresponding to FIGS. 30 to 32 respectively.
Figure 34:
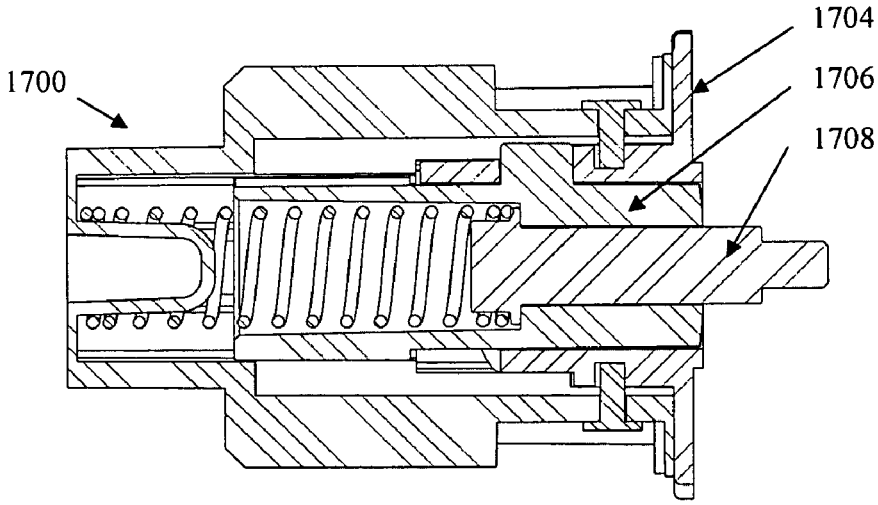

The idler 1700 is typically configured so that the guide member 1730 engages the notch at the middle position 2702, which corresponds to the configuration shown in FIGS. 30 and 33. When the drive member is selectively rotated in a length extending direction (e.g. represented by direction arrow B in FIGS. 18 and 31), the guide member 1730 is guided along the portion of the path 1810 between the middle position 2702 and high position 2704. The primary biasing means 1710 pushes the guide member 1730 away from the rear wall 1902 of the housing 1702, and also pushes the guide member 1730 towards the notch at the high position 2704 while rotating the drive member 1704 at the same time. This effectively configures the core component in the extended position, which corresponds to the configuration shown in FIGS. 31 and 34.

When the drive member is selectively rotated in a length retracting direction (i.e. in a direction opposite to direction arrow B in FIGS. 18 and 31), the guide member 1730 is guided along the portion of the path 1810 either between: (i) the high position 2704 and the middle position 2702, or (ii) the middle position 2702 and the low position 2700. In the case of condition (i), the idler 1700 is configured from the configuration shown in FIGS. 31 and 34 to the configuration shown in FIGS. 30 and 33. In the case of condition (ii), the idler 1700 is configured from the configuration shown in FIGS. 30 and 33 to the configuration shown in FIGS. 32 and 35.

Figure 32:
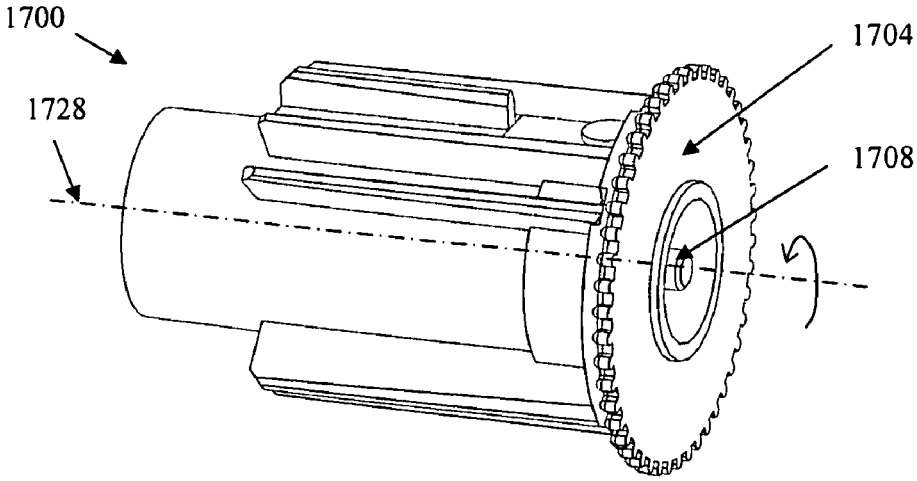
Figure 35:
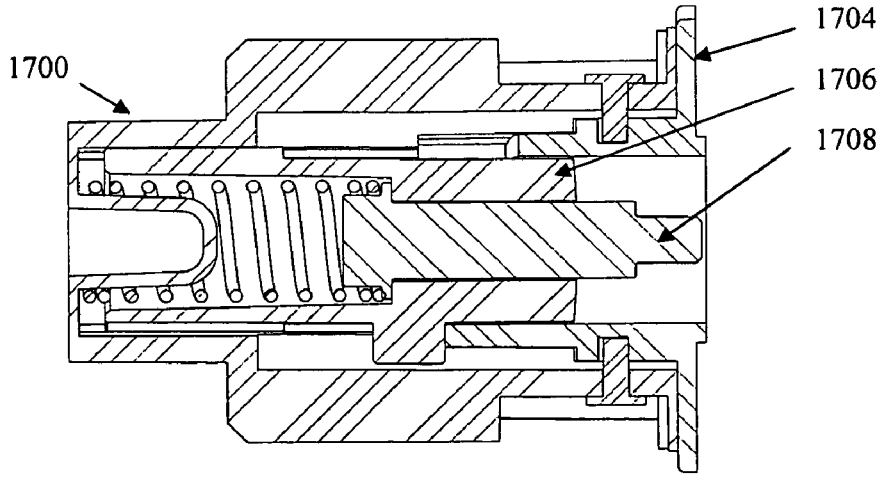
Figure 36:
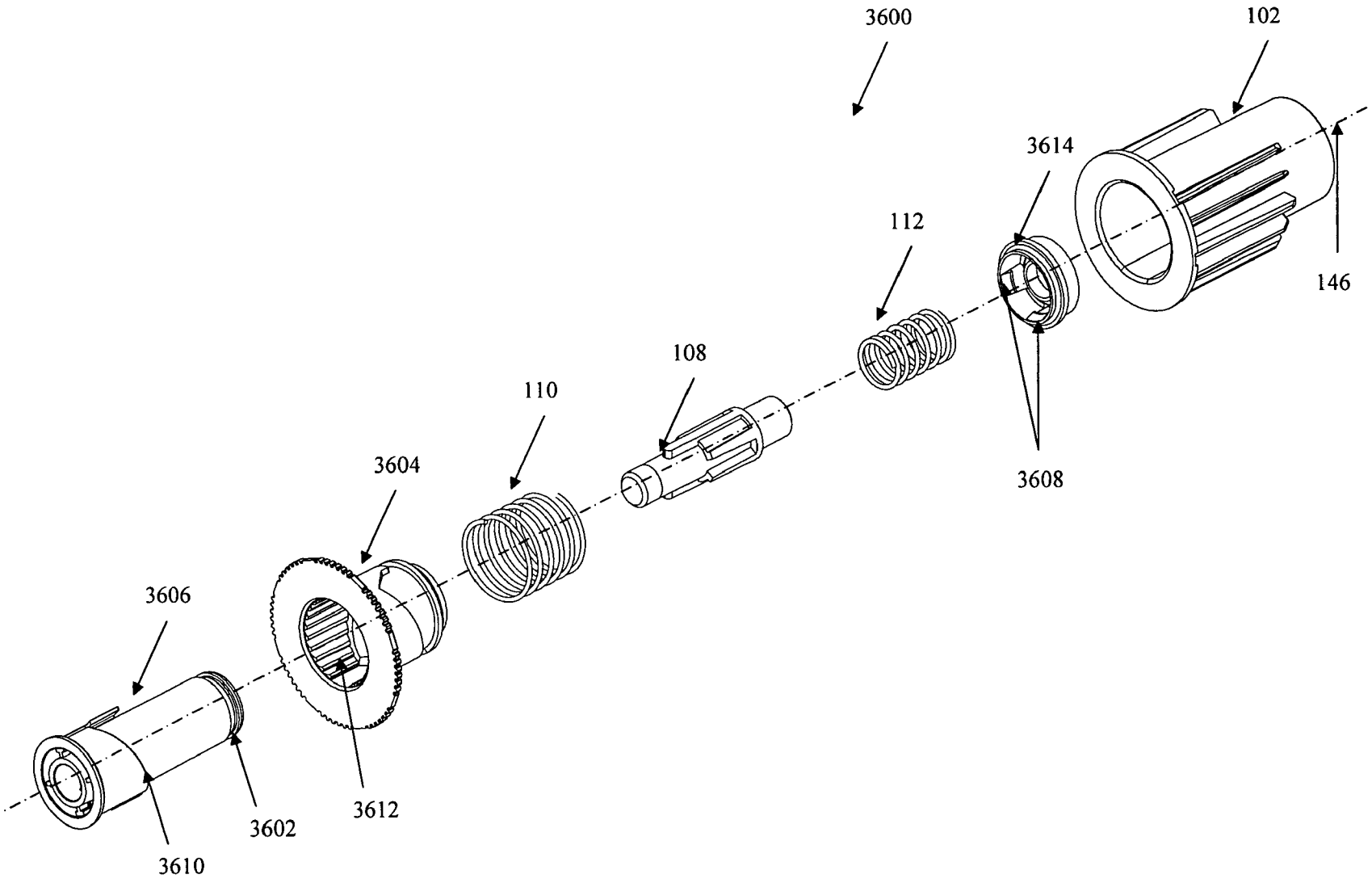
FIGS. 36 to 52 show aspects of a third representative embodiment of an idler.
Figure 37:
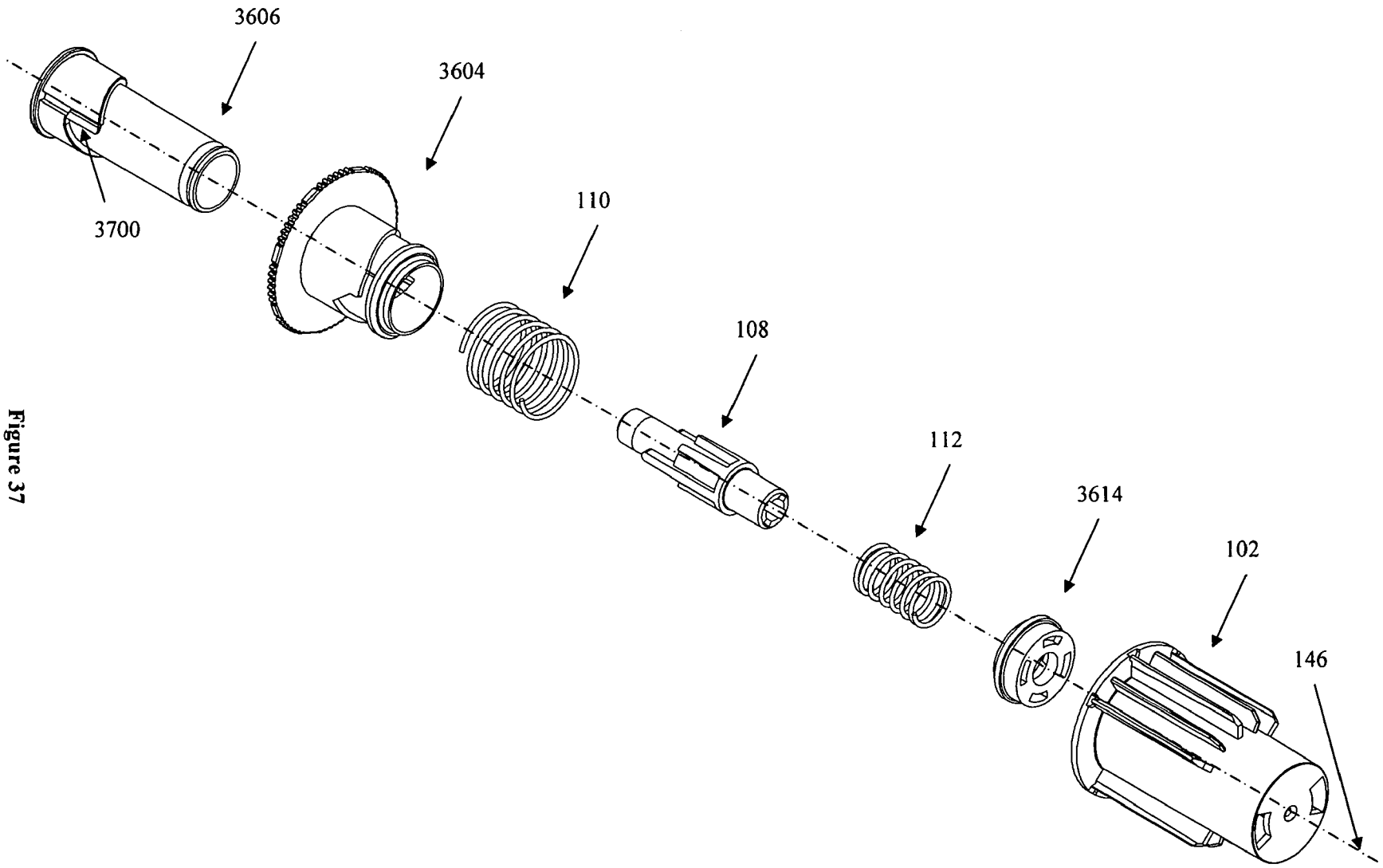
Figure 38:
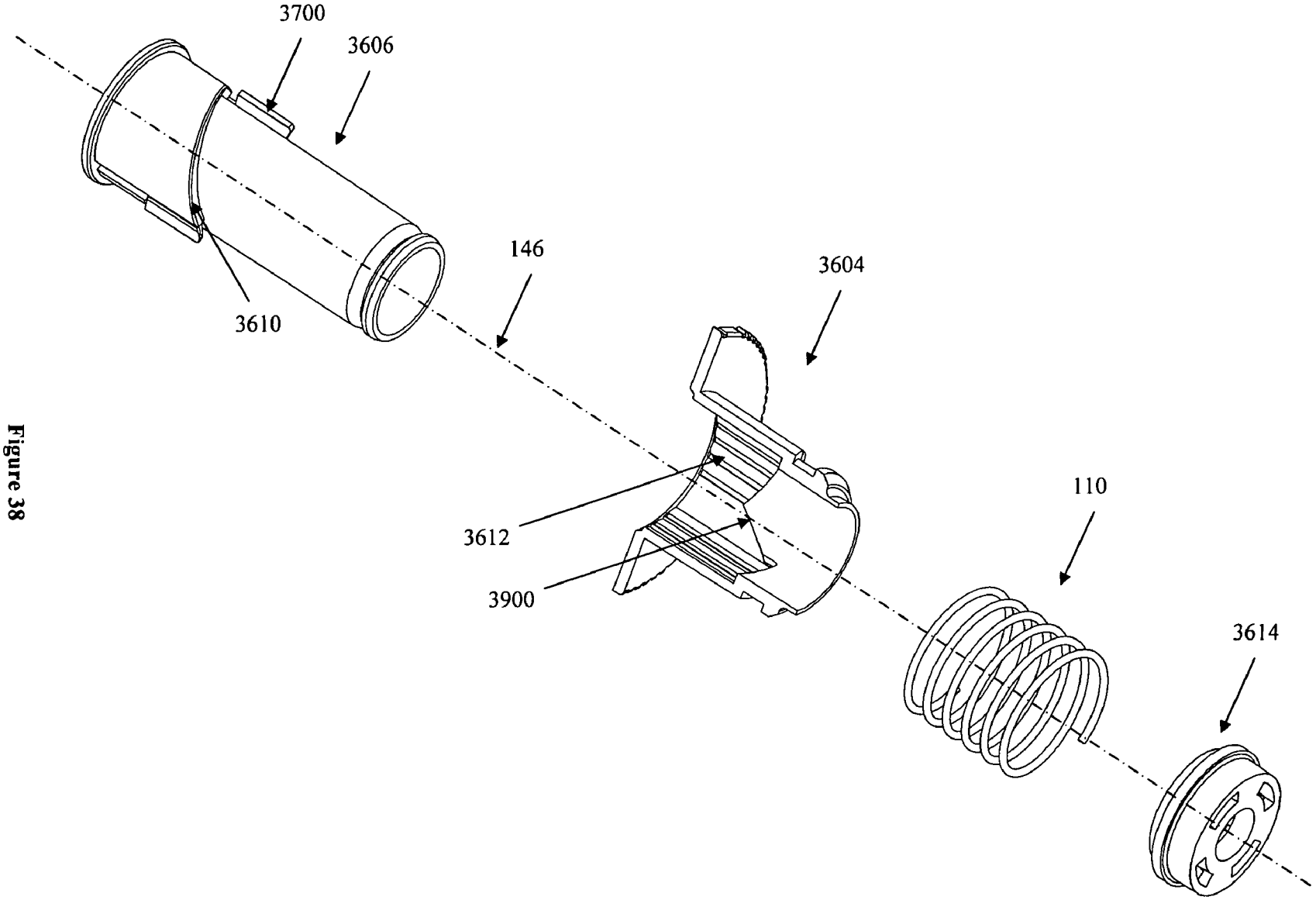
Figure 39:
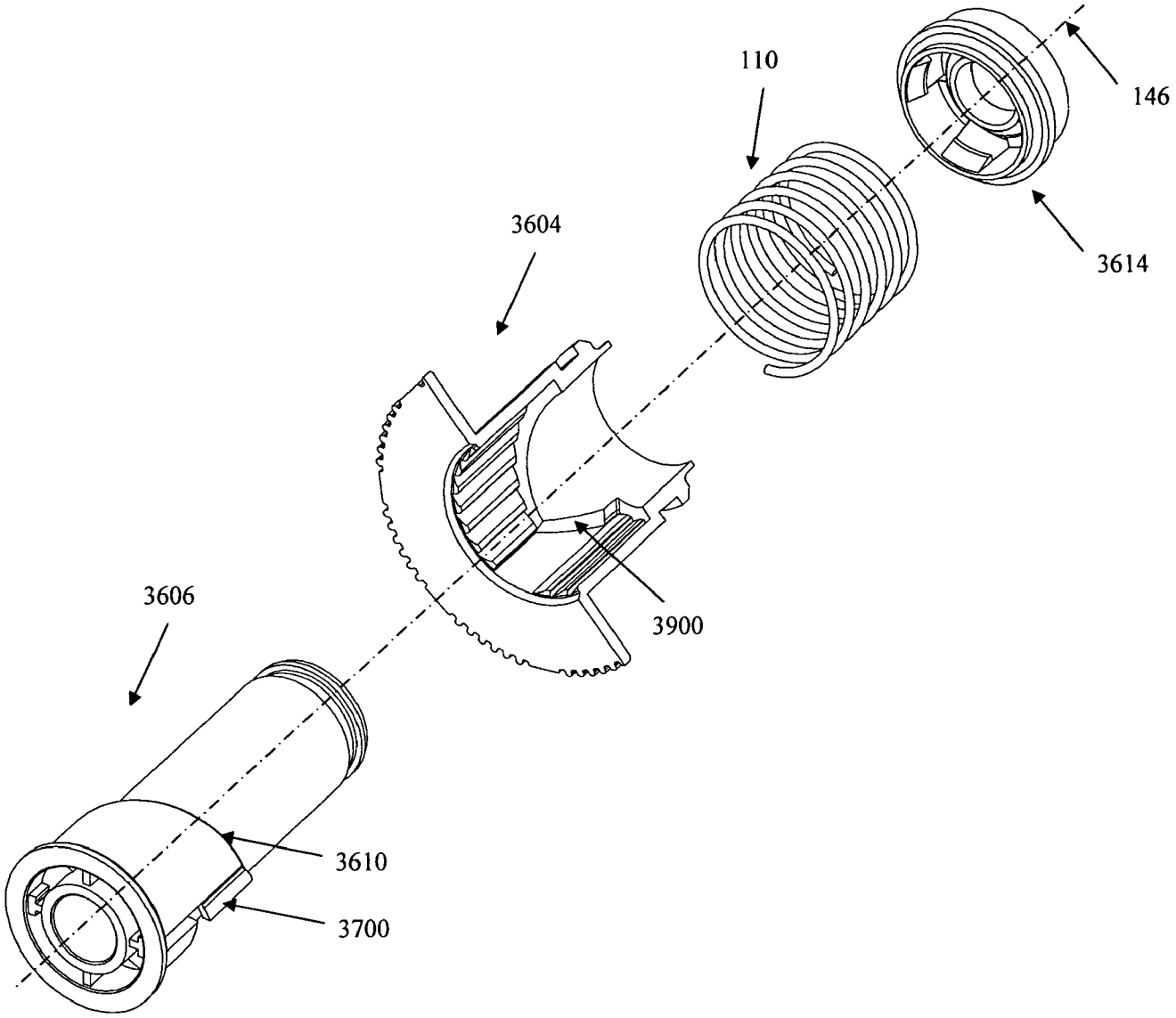
Figure 40:
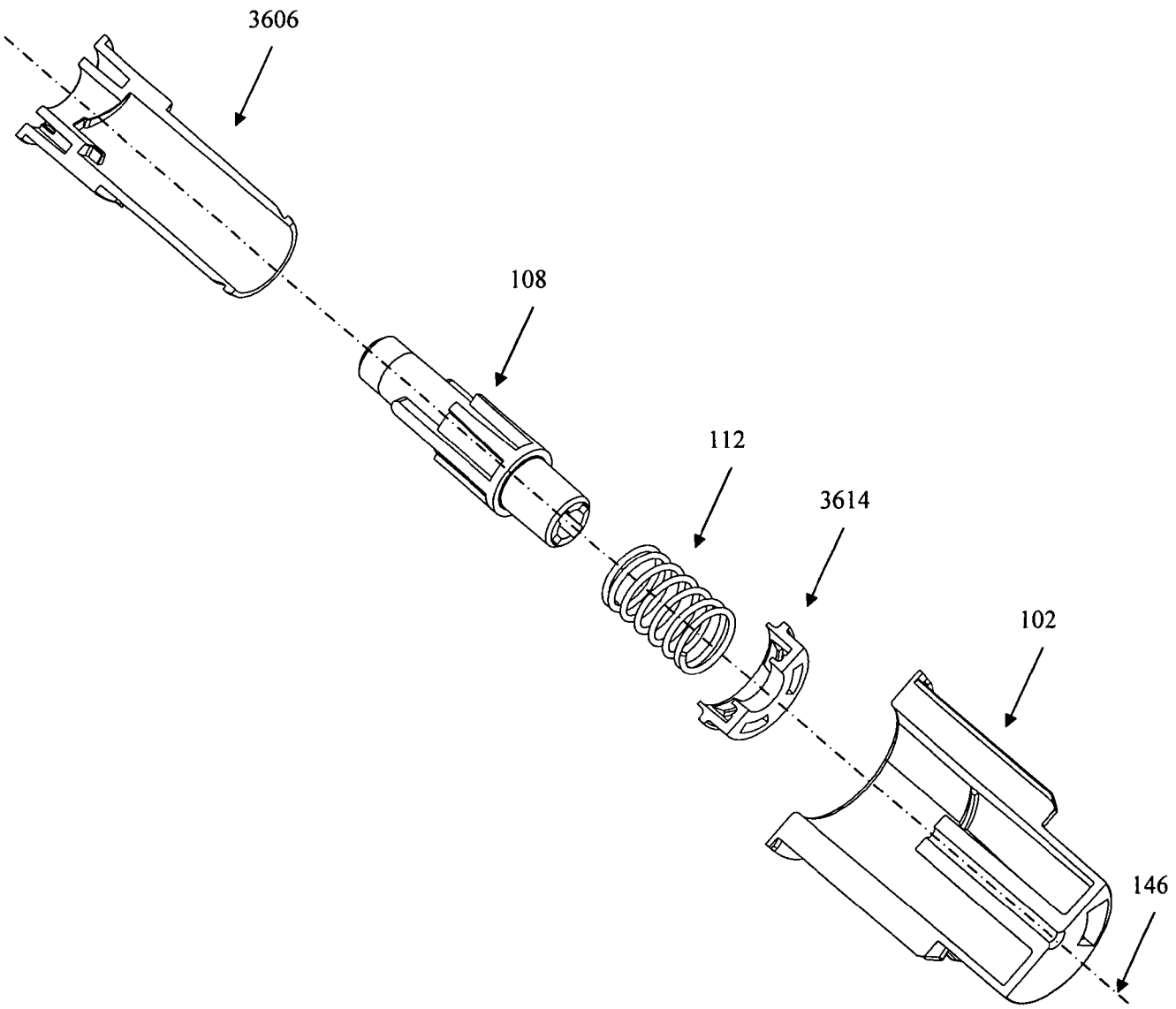
Figure 41:
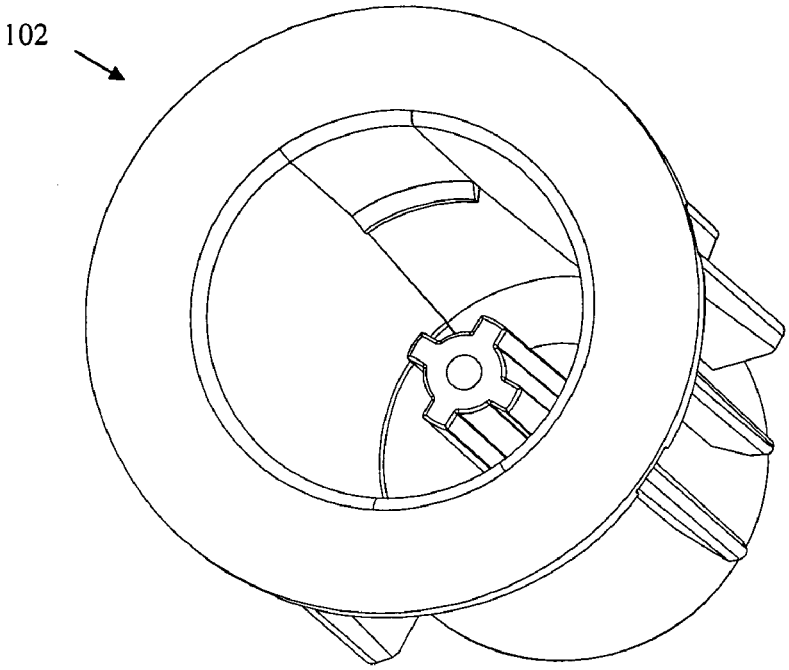
Figure 42:
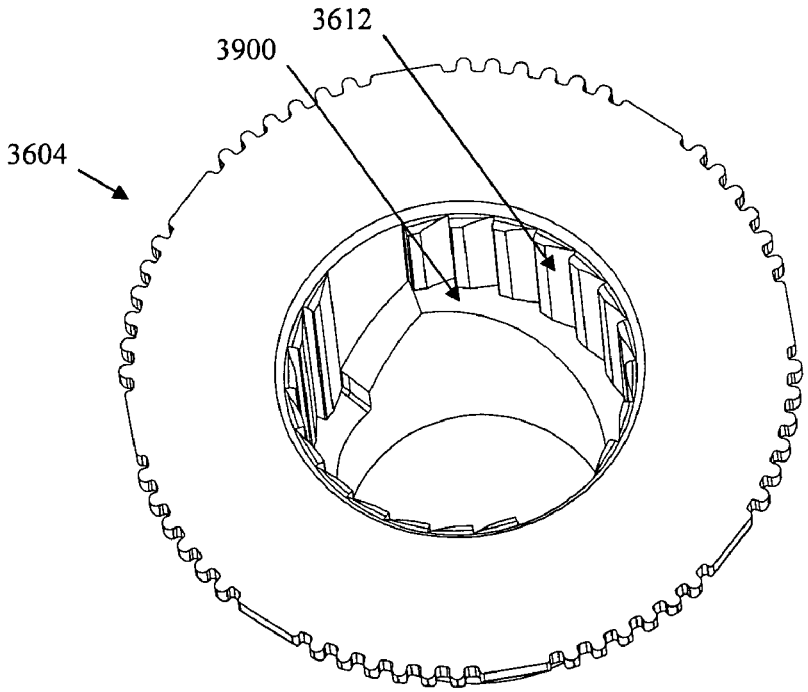
Figure 43:
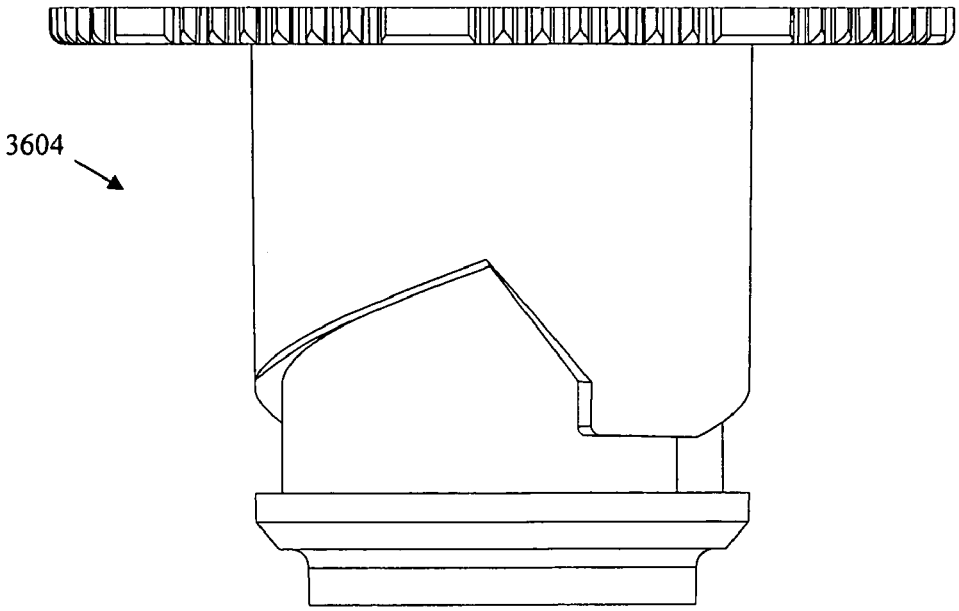
Figure 44:
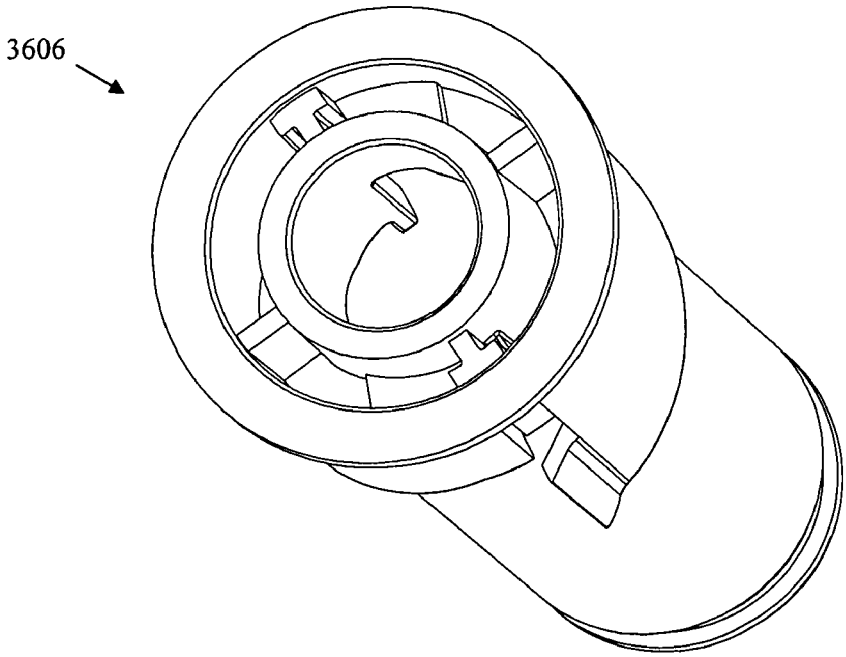
Figure 45:
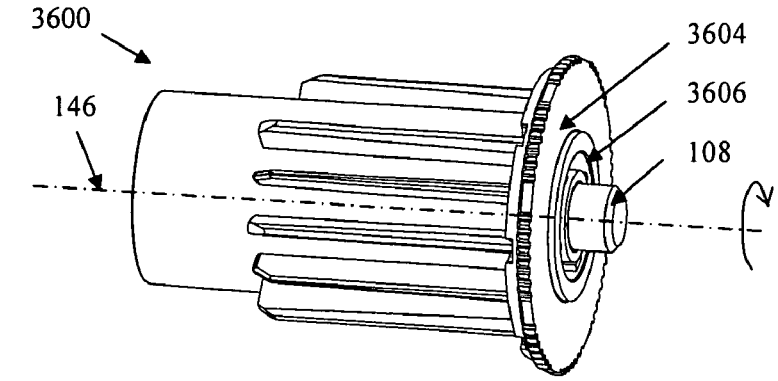
Figure 46:
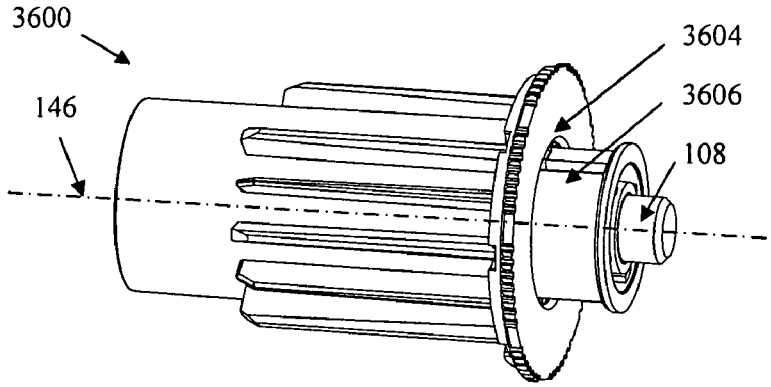
Figure 47:
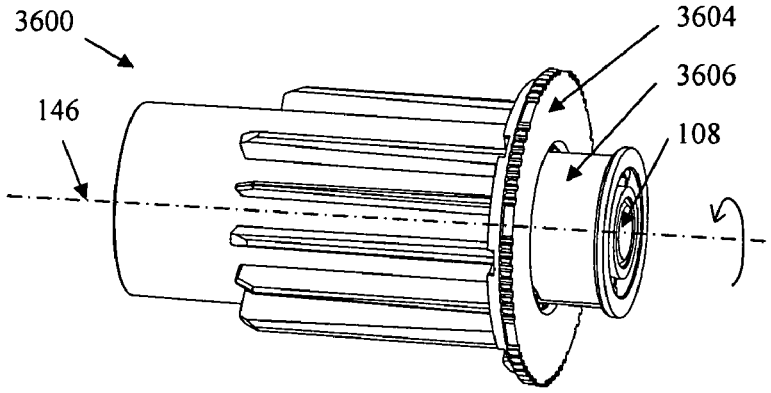
Figure 48:
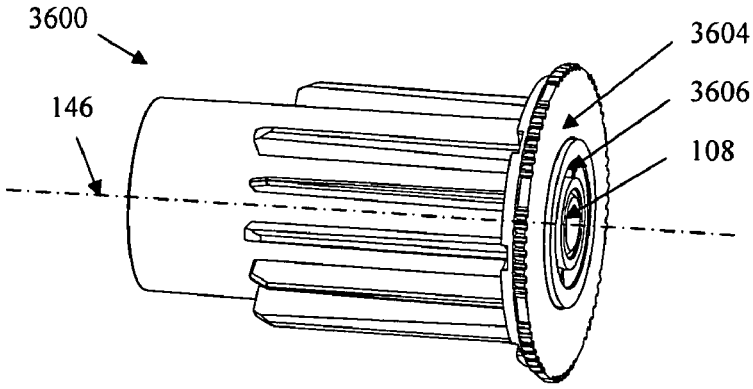
Figure 49:
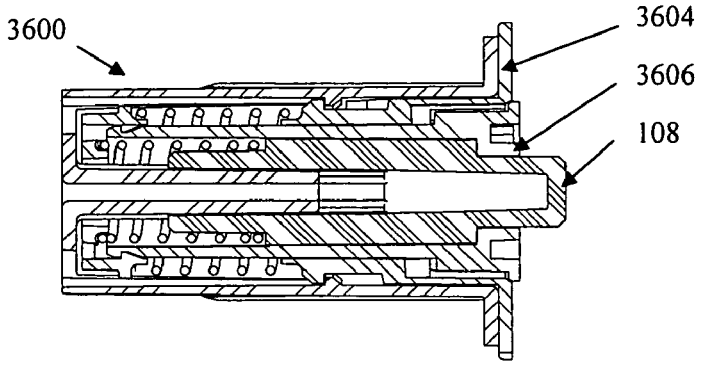
Figure 50:
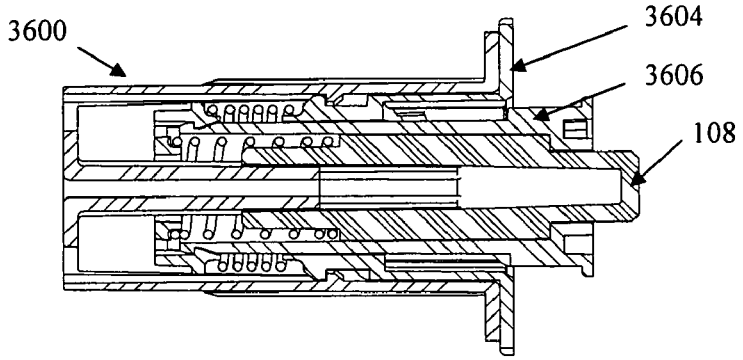
Figure 51:
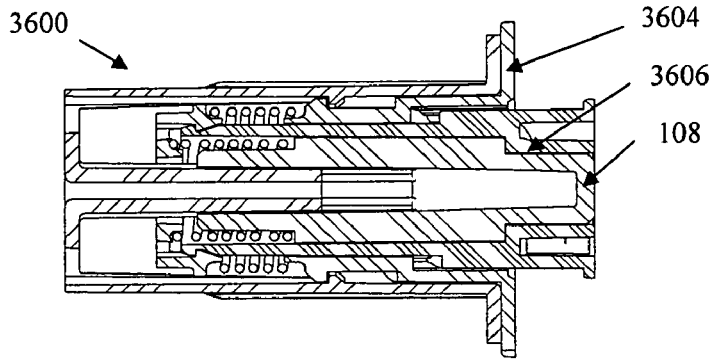
Figure 52:
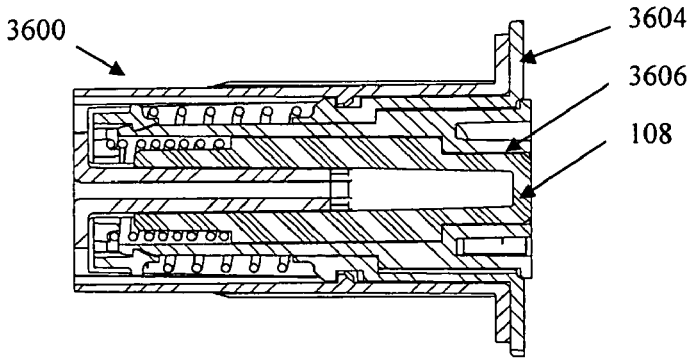

In the configuration shown in FIGS. 32 and 35, the support member 1708 is wholly received within the housing 1702 and is placed in the retraced position. In this position, the idler can be conveniently removed from the mounting bracket.

FIGS. 36 to 52 relate to a third representative embodiment of an idler 3600, and correspond to the views shown in FIGS. 1 to 16 in relation to the first representative embodiment of the idler 100 described herein. The idler 3600 has the same housing 102, support member 108, primary biasing means 110 and secondary biasing means 112 as the idler 100. However, the idler 3600 has a different drive member 3604, core member 3606 and locking sleeve 3614.

The idler 3600 is assembled in the same manner as described for the idler 100, except for the coupling between the core member 3606 and the locking sleeve 3614. The locking sleeve 3614 is formed as a cap for fitting over an enlarged end portion 3602 of the core member 3606. For example, the enlarged end portion 3602 may include a ring member protruding from an outer surface of the core member 3606, and/or may include a recessed area formed into the outer surface of the core member 3606 so that an end portion of the core member 3606 is larger than the recessed area. The locking sleeve 3614 includes one or more tab members 3608 protruding inwardly from an inner surface of the locking sleeve 3614. When the locking sleeve 3614 is fitted over the enlarged end portion 3602, the tab members 3608 engage the enlarged head portion 3602 to resist detachment from each other.

The drive member 3604 includes a continuous drive surface 3900 (see FIG. 39) forming a helically shaped path. The core member 3606 includes a correspondingly shaped continuous surface 3610 for engaging the drive surface 3900. The core member 3606 also includes one or more locking members 3700 protruding from an outer surface of the core member 3606, which is shaped for engaging any one of the different grooves of a serrated surface 3612 formed as part of an inner surface of the drive member 3604. When the drive member 3604 is rotated, each locking member 3700 engages one of grooves of the serrated surface 3612 and configures the core member 3606 to a different position relative to the drive member 3604. In this configuration, the engagement between the locking members 3700 and the groove of the serrated surface 3612 resist further rotation of the core member 3606 relative to the drive member 3604 unless a user exerts sufficient rotational force to reposition the relative location of the parts 3604 and 3606. Due to the helical shape of the drive surface 3900 and the corresponding surface 3610 on the core member 3606, the core member 3606 extends to a different retaining position relative to the drive member 3604.

It can be appreciated that the support members 108 and 1708 for the different embodiments of the idler 100, 1700 and 3600 described herein are biased to move away from the respective housing 102 and 1702 (and along either axis 146 or 1728) under the force exerted by the respective biasing means 112 and 1710. Regardless of the position of the core member 106, 1706 and 3606 relative to the drive member 104, 1704 and 3604, the support members 108 and 1708 can also move towards the respective housing 102 and 1702 when pushed to move in that direction (e.g. by a user) along the axis 146 or 1728.

Modifications and improvements to the invention will be readily apparent to those skilled in the art. Such modifications and improvements are intended to be within the scope of this invention. For example, although the representative embodiments referred to above describe the core member 106 and the support member 108 as being separate parts, it is possible to provide a single member that performs the combined function of the core member 106 and support member 108. For example, the core member 106 may include a support portion shaped for engaging a part of the supporting structure (e.g. a mounting bracket) for supporting the fitting, where the support portion includes the connecting portion 122 of the support member 108 (as described above). Further, the support portion of the core member 106 may also be retractable or extendable relative to the core member 106 (similar to the support member 108 described above).

In an alternative representative embodiment, the core member 106 is held in a fixed position along the axis 146 relative to the drive member 104, and the distance between the drive member 104 and housing 102 is adjustable in length. For example, the drive member 104 can disengage with the housing 102 (e.g. by rotating the drive member 104 relative to the housing 102) to allow the distance between the drive member 104 and the housing 102 to be adjusted (e.g. telescopically) to a different selected position. The drive member 104 can then re-engage with the housing 102 (e.g. forming a secure locking engagement by rotating the drive member 104 relative to the housing 102) to resist movement of the drive member 104 or housing 102 along the axis 146 from the selected position.

In another alternative representative embodiment, at least one of the drive member 104 and the housing 102 may have a threaded portion (e.g. a screw thread), so that selective rotation of the housing 102 or drive member 104 (relative to each other) enables the core member 106 to move along the axis 146 to a different position relative to the housing (e.g. when the core member 106 is held in a fixed position along the axis 146 relative to the drive member 104).

In the alternative representative embodiments described above, it can be appreciated that the same concept of operation can be applied for adjusting the distance between the core member 106 and the drive member 104 (when the drive member 104 is held in a fixed position along the axis 146 relative to the housing 102).

In this specification where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

The word 'comprising' and forms of the word 'comprising' as used in this description and in the claims does not limit the invention claimed to exclude any variants or additions.

The invention claimed is:

1. A length adjustable fitting for blind systems, comprising:

a housing and a drive member fitted to said housing;

a core component including a core member shaped for engaging a drive portion of said drive member, the core component including a support portion shaped for engaging a support member for supporting said fitting;

wherein, the selective adjustment of the drive member relative to the housing moves the core member along an axis to a different position relative to the housing, wherein at each said position, the drive member engages the core member to resist movement of the core member along the axis from said position relative to said housing;

wherein, said drive portion includes a helically shaped path for engaging a guide portion of said core member;

wherein, at each said retaining position, said drive member engages said core member at a different relative position to resist movement of said core member along said axis relative to said drive member in the absence of rotation of said drive member relative to said housing; and, wherein said drive member includes one or more of the following:

i) a wall portion surrounding a hollow core shaped to define said helically shaped path for engaging a guide member projecting from said core member; and ii) a first serrated surface for engaging a second serrated surface formed as part of said guide portion, said second serrated surface having a shape corresponding to said first serrated surface.

2. A fitting as claimed in claim 1, wherein:

when said drive member is rotated in a length extending direction, the first and second serrated surfaces move relative to each other into different locking positions for adjusting the position of the core component relative to said housing; and when said drive member is rotated in a length retracting direction, the first and second serrated surfaces engage each other to resist adjustment to the position of the core component along said axis relative to the drive member.

3. A fitting as claimed in claim 1, wherein said drive member includes:

a wall portion surrounding a hollow core shaped for receiving at least a portion of said core component, said first serrated surface being formed on an inner surface of said wall portion, and said second serrated surface being formed on an outer surface of said core component.

4. A fitting as claimed in claim 1, wherein:

when the drive member is rotated relative to said housing in a length extending direction, the core component moves towards an extended position where a portion of said core component is positioned outside of said housing; and when the drive member is rotated relative to said housing in a length retracting direction, the core component moves towards a retracted position where said core component is wholly received within said housing.

5. A fitting as claimed in claim 4, wherein the core component is operable according to either one or both of options (i) and (ii) below:

i) when the core component is placed in the extended position:

rotation of the drive member in the length extending direction moves the core component towards the retracted position; and rotation of the drive member in the length retracting direction causes the drive member and the core component to engage so as to resist movement of the core component towards the retracted position; and ii) when the core component is placed in the retracted position:

rotation of the drive member in the length extending direction moves the core component towards the extended position; and rotation of the drive member in the length retracting direction causes the drive member and the core component to engage so as to resist movement of the core component towards the retracted position.

6. A fitting as claimed in claim 1, wherein said core component includes:

a support member including said support portion; and a core member having a tubular body shaped for receiving said support member, said guide portion being formed on a surface of said core member.

7. A fitting as claimed in claim 6, wherein:

said support member is selectively moveable along said axis between a retracted position and an extended position;

such that when the support member is configured in the retracted position, and end portion of the support member is wholly received within said housing, and when the support member is configured to the extended position, said end portion of the support member is projected outside of said housing.

8. A fitting as claimed in claim 7, wherein the support member is operable according to either one or both of options (i) and (ii) below:

i) when the support member is configured to the extended position:

rotation of the drive member in a length extending direction causes the support member and the core member to engage so as to resist further extension of the support member; and rotation of the drive member in a length retracting direction moves the support member towards the retracted position; and ii) when the support member is configured to the retracted position:

rotation of the drive member in a length extending direction moves the support member towards the extended position; and rotation of the drive member in a length retracting direction causes the support member and the core member to engage so as to resist further retraction of the support member.

9. A fitting as claimed in claim 6, wherein:

said support member is shaped to include a guide member for engaging a cam surface formed in the cam portion of said core member; wherein:

when said drive member is rotated in said first direction, the guide member and cam surface engage each other in a locking arrangement to resist adjustment of the position of the support member relative to the core member; and when said drive member is rotated in said opposite direction, said guide member follows said cam surface for adjusting the position of said support member relative to the core member.

10. A fitting as claimed in claim 9, wherein said core member has a hollow shaped for receiving at least a portion of said support member, the cam surface being formed on at least a part of an inner surface of the core member surrounding said hollow, and the protruding member being formed on an outer surface of the support member.

11. A fitting as claimed in claim 7, wherein:

the support member moves towards the retracted position when a force is applied to move the support member in the when force is applied to the move the support member towards the retracted position; and the support member being biased to move towards the extended position when said force is no longer applied.

12. A fitting as claimed in claim 6, wherein said support member has at least one of the following:

a hollow shaped for receiving a correspondingly shaped projection extending from the housing, where the engagement between the hollow and the projection resist rotation of the support member relative to the housing; or an end portion adapted for engaging said support member for supporting said fitting.

13. A fitting as claimed in claim 1, wherein the drive member has a flanged portion for engaging a rib portion of the housing so as to resist separation of the drive member from the housing.

* * * * *